US009421439B2

(12) United States Patent
McLoughlin

(10) Patent No.: US 9,421,439 B2
(45) Date of Patent: Aug. 23, 2016

(54) GRIP FOR A GOLF CLUB

(76) Inventor: Enda McLoughlin, Wicklow Town (IE)

( * ) Notice: Subject to any disclaimer, the term of this patent is extended or adjusted under 35 U.S.C. 154(b) by 169 days.

(21) Appl. No.: 13/811,061

(22) PCT Filed: Jul. 19, 2011

(86) PCT No.: PCT/EP2011/062384

§ 371 (c)(1),
(2), (4) Date: Jan. 18, 2013

(87) PCT Pub. No.: WO2012/010609

PCT Pub. Date: Jan. 26, 2012

(65) Prior Publication Data

US 2013/0130825 A1 May 23, 2013

Related U.S. Application Data

(60) Provisional application No. 61/344,431, filed on Jul. 21, 2010.

(51) Int. Cl.

| | |
|---|---|
| ***A63B 53/14*** | (2015.01) |
| ***A63B 59/00*** | (2015.01) |
| *A63B 53/00* | (2015.01) |

(52) U.S. Cl.

CPC ..... *A63B 53/14* (2013.01); *A63B 59/0025* (2013.01); *A63B 60/08* (2015.10); *A63B 60/10* (2015.10); *A63B 60/12* (2015.10); *A63B 60/34* (2015.10); *A63B 53/007* (2013.01)

(58) Field of Classification Search

CPC .. A63B 59/055; A63B 59/0025; A63B 53/14; A63B 53/16; A63B 60/08; A63B 60/12; A63B 60/10; A63B 60/34; A63B 53/007; A63B 59/00

See application file for complete search history.

(56) References Cited

U.S. PATENT DOCUMENTS

| | | | | |
|---|---|---|---|---|
| 4,065,127 | A | 12/1977 | Fagan | |
| 4,272,077 | A | 6/1981 | Spivey | |
| 4,310,158 | A * | 1/1982 | Hoffman | 473/204 |
| 5,429,356 | A * | 7/1995 | Dingle et al. | 473/251 |
| 5,460,375 | A * | 10/1995 | Hardee | 473/300 |
| 5,749,792 | A | 5/1998 | Engfer et al. | |
| 5,964,668 | A | 10/1999 | Tai et al. | |
| 6,152,832 | A * | 11/2000 | Chandler, III | 473/293 |
| 6,503,151 | B2 * | 1/2003 | Kosovac | 473/244 |
| 6,558,269 | B1 * | 5/2003 | McBee | 473/248 |
| 6,988,959 | B2 * | 1/2006 | Pollman | 473/313 |
| 7,141,197 | B2 * | 11/2006 | Chadwick et al. | 264/250 |
| 8,062,147 | B2 * | 11/2011 | Johnson | 473/303 |
| 2002/0077191 | A1 | 6/2002 | Roelke | |
| 2006/0068929 | A1 | 3/2006 | Goldfader | |
| 2007/0026959 | A1 * | 2/2007 | Boone | 473/300 |

FOREIGN PATENT DOCUMENTS

| | | |
|---|---|---|
| WO | 2006/043887 | 4/2006 |

* cited by examiner

*Primary Examiner* — Stephen Blau
(74) *Attorney, Agent, or Firm* — Greenblum & Bernstein, P.L.C.

(57) ABSTRACT

A golf club such as a putter having a club shaft with an upper end and a lower end and a longitudinal axis; a club head on a lower end of the shaft and with a lie angle between the shaft and the club head; and a grip on an upper end of the shaft. The grip provides an increased effective lie angle. The lie angle between the shaft and the club head is in the range from about 67° to about 75° and the effective lie angle is in the range from about 76° to about 85°. The grip improves the performance of the golfer.

20 Claims, 18 Drawing Sheets

Personal Competence Profile

Summary:

| Technique | Timing | Consistency | Overall Rating |
|---|---|---|---|
| 76.3% | 55.4% | 51.1% | 58.5% |

Personal Competence Profile

Summary:

| Technique | Timing | Consistency | Overall Rating |
|---|---|---|---|
| 84.4% | 42.5% | 59.7% | 61.6% |

Personal Competence Profile

Summary:

| Technique | Timing | Consistency | Overall Rating |
|---|---|---|---|
| 77.2% | 75.6% | 38.5% | 57.4% |

Personal Competence Profile

Summary:

| Technique | Timing | Consistency | Overall Rating |
|---|---|---|---|
| 77.0% | 78.4% | 64.1% | 70.9% |

Personal Competence Profile

Summary:

| Technique | Timing | Consistency | Overall Rating |
|---|---|---|---|
| 72.6% | 78.7% | 73.5% | 74.6% |

Personal Competence Profile

Summary:

| Technique | Timing | Consistency | Overall Rating |
|---|---|---|---|
| 81.3% | 83.9% | 83.5% | 83.0% |

GRIP FOR A GOLF CLUB

FIELD OF THE INVENTION

The present invention relates to the field of golf clubs such as golf putters, and in particular to a golf club grip for example a putter grip allowing positioning of the hands/arms for optimum striking of a golf ball.

BACKGROUND TO THE INVENTION

Golf is one of the most widely played sports in the world, with skill levels ranging from the casual participant who play the game as a hobby to full-time professionals who make a living from playing the game. Regardless of the skill level of the golfer, one of the most important parts of the golfer's game is the ability to hit a golf ball using a golf club such as a putter accurately and consistently to make the shot or "make the putt" each time. "Making the putt" is a term used by golfers to describe the golf shot where a putter is used on the greens of a golf course to hit the ball into the hole. If a golfer's putting swing or putting ability is poor, lacks consistency or is very inaccurate, the golfer's game suffers and their improvement in performance stagnates. As such, the golfer's ability with the putter is key to a player trying to improve his/her golfing game.

A number of golfing aids have been introduced to improve a golfer's putting ability, ranging from home-putting kits (for example, the Boomerang® Putting Professional) to laser putting aids (for example, as described in U.S. Pat. No. 5,964,668). However, no amount of putting aids will improve the golfer's putting skill if the positioning of the golfer's hands on the putting grip are incorrect.

The most conventional method used to grip the putter correctly is called the "reverse overlap method". In essence, this involves the golfer placing the weaker hand (left hand for right-handed golfers and vice versa) at the top of the grip and the stronger ("lead") hand grasping the grip beneath the weaker hand. There is then, more often than not, an overlap of the index finger of the weaker hand over the little, ring, and middle finger of the stronger hand. The thumbs of both hands should be positioned in the middle of the grip and pointing down towards the club head.

There have been many attempts to develop the grip used by golfers when putting, or in fact the putter grip itself. Conventional putter grips generally comprise a grip material wound around the top of the club shaft or a pre-moulded grip. The grip may have indents or dimples, and the like on the surface of the material to aid the golfer's grip. These surface additions are thought to aid the correct positioning of the golfer's hands when gripping the club. Despite the use of such surface features, the problem of incorrect positioning of the golfer's hands on the putter grip remains prevalent, leading to inaccurate and inconsistent putting by the golfer. There have been some attempts at further improving the golf putter grip.

US Patent Publication No. 2006/0068929 discloses an oversized golf putter grip being substantially paddle-shaped and designed to be gripped by both hands where the hand positions are one on each side of the grip and directly mirror each other and where both hands may rest on the grip along side each other in a parallel relationship with respective line of each arm forming opposing sides of a substantially isosceles triangle with the shoulder line as the base. The grip includes a substantially flat surface facing upwards when the club is held during use, and a variety of surface shapes facing downwards.

U.S. Pat. No. 4,272,077 discloses a golf putter grip having a cylindrical shape and which is substantially larger than that of the shaft diameter. One of the purposes of this particular grip is described to enable the non-dominant hand to be in a muscle-relaxed position during putting while providing additional support and balance.

US Patent Publication 2002/0077191 discloses a golf putter grip, which includes an over-sized elongated cylindrical body extending from an upper end of the grip to a lower end. The lower end of the grip is substantially greater in diameter than the shaft and so a step is formed between its lower end and the shaft. The purpose of this "step" is for receiving the user's index and middle fingers of his or her forward hand on opposite sides of the shaft. The grip is also described as being optionally constructed of two components, an inner plastic sleeve and outer pliant sleeve. The grip has one flat side.

U.S. Pat. No. 5,749,792 discloses a golf club oversize grip kit comprising a set of covers of diverse sizes, which can be slipped over a handle of a golf club and in particular a grip of the club. The covers are described as being manufactured from a foamed synthetic resin or equivalent, which deforms under the user's grasp, conforming to the user's hand, thereby providing maximal surface area contacting the hand.

However, the problem of inconsistent and incorrect grip position on a golf club such as a putter grip remains a fundamental problem in the golfer's game. A common problem found with the putter grip of the prior art is that the golfer grips the club/putter too tight, which creates tension through the hands, arms, and shoulders. The present invention aims at resolving these deficiencies.

SUMMARY OF THE INVENTION

The present invention provides a golf club comprising a club shaft having an upper end and a lower end and a longitudinal axis; a club head on a lower end of the shaft and with a lie angle between the shaft and the club head; and a grip on an upper end of the shaft. The grip provides an increased effective lie angle. The present invention is advantageous as it increases performance as demonstrated below but without altering the actual lie angle between the club shaft and the club head.

Desirably the lie angle between the shaft and the club head is in the range from about 67° to about 75°, such as in the range from about 76° to about 85° for example in the range from about 77° to about 84°. The effective lie angle may be in the range from about 78° to about 83°, such as in the range from about 79° to about 84°, for example in the range from about 79° to about 83°. The effective lie angle may be in the range from about 79° to about 82°, such as from about 80° to about 83° for example in the range from about 80° to about 82°. The effective lie angle may be in the range from about 81° to about 82°.

The advantages of the grip for example putter grip of the present invention is that in the lead wrist, ulnar deviation is increased therefore creating a plumb/flush plane line between the elbow joint and the club head. This in turn, speaking from a striking/putting performance perspective, reduces club/putter face rotation and variations of said rotation through impact. This has a direct impact on the line and precision of the putt as the face position at impact is the most influential of all impact factors.

The grip also decreases the pressure in the hands which increases feel for example on long putts. This is due to the fact that both hands are bio-mechanically in a position that decreases grip pressure. Speed is therefore determined by length of stroke rather than acceleration. The path of the stroke is influenced positively by the fact that the grip places emphasis on the scapulo-thoracic area now becoming the fulcrum of the movement, therefore neutralising inefficient putter path tendencies.

Desirably the grip has a longitudinal axis and the longitudinal axis of the grip and the longitudinal axis of the shaft converge in a direction toward the club head. This is one simple yet highly effective way of creating an effective increased lie angle without altering the relative position of the shaft to the club head.

Suitably the grip is elongate in cross-sectional shape with a greater part of the grip extending on a side of the shaft opposite to a side on which the club head extends. This means that the grip has a shape that is likely to result in a better orientation of the club when being held because the elongate shape is less likely to be held with the club face at an incorrect orientation. One simple yet effective arrangement is where the elongate cross-sectional shape is substantially that of an ellipse with flat sides. This provides a comfortable grip which is highly effective in achieving correct gripping by the hands. Desirably the grip tapers inwardly in a direction down the shaft and on a side of the shaft opposite to a side on which the club head extends. Again this provides a good gripping profile.

Desirably a shaft-receiving bore is defined in the grip and the bore is offset from a central position of the grip and is positioned toward the side of the grip which is opposite to the side on which the club head extends. This is one easy way to help create the desired increase in effective lie angle. In particular it is desirable that less than 20% of the (diameter along the major axis) grip is on the side of the shaft opposite the club head, such as less than 19%. At the top end of the grip it is desirably less than 18% such as less than 17%.

The grip may be substantially rigid so there is substantially no deformation when gripped. The part of the grip on a side of the shaft on the same side as that on which the club head extends (the bigger part of the grip) may be (resiliently) deformable when gripped by a user. This provides a comfort grip that gives somewhat under the normal gripping pressure. Being deformable it changes its shape and/or volume while being acted upon by an external force applied by the hands and returns to its original shape or volume when the external force is removed.

Desirably the part of the grip on the same side of the shaft as that on which the club head extends is at least partially hollow. Again this provides for ease of gripping.

Suitably the grip is dimensioned to fill the palm of the hand between the thumb and the knuckles at the midfinger position of the hand. Filling the hands in this way means the desired relative orientation of the club head to the hands (and thus the arms) is achieved.

The dimensions of the grip and the increased effective lie angle together act to align the forearms of a user with each other along the same plane and said plane is parallel to a longitudinal axis of the shaft all in a gripping position of the club. This means the golf swing is much improved and that much improved position is achieved consistently.

Desirably a longitudinal finger groove is provided on one side of the grip which seat the tips of fingers of the user in a gripping position. Desirably a groove is provided on each of opposing sides of the grip. Again this helps with finger positioning to achieve an ideal grip position of the hands.

The golf club grip may be manufactured from one or more suitable materials. Desirably it comprises at least one thermoplastic elastomer. Thermoplastic elastomers include styrene-based, polyolefin blends, polyurethanes, polyester-based and polyamide-based materials. The material may be in the form of a foam. It is desirable to use polyurethane materials for example a polyurethane foam. The material may be selected based on its visco-elastic properties. The material may have a Shore A hardness in the range from about 30 to about 80.

The invention also relates to a grip for a golf club wherein the golf club comprises: a club shaft having an upper end and a lower end and a longitudinal axis; and a club head on a lower end of the shaft and with a lie angle between the shaft and the club head. The grip is for fitting on an upper end of the shaft, and is adapted to provide an increased effective lie angle. The grip of the invention can have all or any combination of features set out herein.

The invention extends to a golf club grip and/or golf club as described herein with reference to and as illustrated in the accompanying figures.

The length of the grip may range from about 20 cm to about 40 cm, preferably from about 22 cm to about 30 cm, more preferably from about 24 cm to about 28 cm. It is desirable that the grip length is about 26.5 cm. The cross-sectional diameter of the grip along the longest (major) axis is: (i) at the upper end of the grip member from about 3.90 cm to about 4.4 cm, preferably from about 3.95 cm to about 4.35 cm, more preferably from about 4.0 cm to about 4.3 cm, and desirably about 4.27 cm; (ii) midway down the grip from about 3.3 cm to about 3.7 cm, preferably from about 3.5 cm to about 3.65 cm, and desirably about 3.6 cm; and (iii) at the lower end of the grip where the shaft exits the grip member from about 2.3 cm to about 3.0 cm, preferably from about 2.5 cm to about 2.8 cm, and desirably about 2.7 cm. The diameter of the grip at its widest is within the cross-sectional dimensions permitted by Official Golf Rules maintained by the United States Golf Association (USGA) and the Royal & Ancient Golf Club of St. Andrews, Scotland. The Rules state that ". . . cross-sectional dimensions measured in any direction must not exceed 1.75 inches (44.45 mm)" (which equates to 4.445 cm).

The diameter along the short (minor) axis of the grip is: (i) at the upper portion of the grip member from about 2.30 cm to about 2.70 cm, preferably from about 2.35 cm to about 2.60 cm, and desirably about 2.43 cm; (ii) midway down the grip from about 1.90 cm to about 2.20 cm, preferably from about 2.00 cm to about 2.15 cm, and desirably about 2.10 cm; and (iii) at the lower end where the shaft exits the grip member from about 1.60 cm to about 1.85 cm, preferably from about 1.65 cm to about 1.80 cm, and desirably about 1.734 cm.

Where the shaft occupies a longitudinal bore of the grip member, the distance (along the major axis) from (i) the front surface of the shaft to the front of the upper portion of the grip is from about 1.90 cm to about 2.30 cm, preferably from about 2.00 cm to about 2.20 cm, and desirably about 2.1 cm; (ii) midway down the grip is from about 1.60 cm to about 1.85 cm, preferably from about 1.70 cm to about 1.80 cm, and desirably about 1.80 cm; and (iii) at the lower end where the shaft exits the grip member is from about 0.75 cm to about 1.00 cm, preferably from about 0.85 cm to about 0.95 cm, and desirably about 0.9 cm.

The distance (along the major axis) from the back surface of the shaft to the back of the upper portion of the grip member is from about 0.50 cm to about 0.85 cm, preferably from about 0.60 cm to about 0.75 cm, and desirably about 0.70 cm and at the lower end where the shaft exits the grip member is from about 0.40 cm to about 0.60 cm, and desirably about 0.5 cm. This produces the tapered appearance of the grip of the present invention. Grip size is an important factor in producing consistent putting performance. The range of grip sizes of the grip of the present invention, together with the features of the grip described above, prevent the club from twisting in the golfer's hands which is a result of the golfer subconsciously squeezing the club as the golfer swings in to strike the golf ball, leading to a closed clubface.

The invention also relates to a golf club grip for a golf club, the golf club comprising a club head with a club face for striking a golf ball, and a shaft having a distal end connected to the club head and having a proximal end to which a golf club grip is fitted, the grip comprising a longitudinal grip member having a central longitudinal axis offset from a central longitudinal axis of the shaft of the golf club, wherein a portion the grip member is hollow and defines a longitudinal bore for receiving the proximal end of the shaft of the golf club, the arrangement of the grip member configured to, when being held, fill the palms of the user's hands increasing ulnar deviation and creating a flush plane line between elbow joint and club head.

Desirably the grip comprises a pair of grip members that converge where one of the pair of grip members receives the shaft of the golf club. In one arrangement the portion of the grip member lying furthest away from a body of a user is at least partially hollow. It may define a longitudinal bore for receiving the shaft of the golf club. The portion of the grip member closest to a body of a user may be substantially rigid or deformable when gripped by a user.

The portion of the grip member furthest away from a body of a user may be substantially rigid or deformable when gripped by a user and the portion of the grip member closest to a body of a user is at least partially hollow and defines a longitudinal bore for receiving the shaft of the golf club.

The invention also relates to a golf club grip comprising a longitudinal grip member having a central longitudinal axis offset from a central longitudinal axis of the shaft of the golf club, wherein a portion the grip member is at least partially hollow and defines a longitudinal bore for receiving the proximal end of the shaft of the golf club, the arrangement of the grip member configured to, when being held, fill the palms of the user's hands increasing ulnar deviation and creating a flush plane line between elbow joint and club head.

The invention further relates to a golf club grip comprising two contiguous longitudinal grip members in a side-by-side arrangement with a longitudinal groove intermediate the grip members, wherein one of the grip members is hollow and defines a longitudinal bore for receiving the shaft of a golf club and the other of grip member is substantially rigid or deformable when gripped by a user, the arrangement of the grip members configured to, when being held, fill the palms of the user's hands so that at least a middle and ring finger of the leading hand are positioned in the groove on a side opposite the palm of the leading hand increasing ulnar deviation and creating a flush plane line between elbow joint and club head.

It will be appreciated that all optional and/or preferred features of one embodiment of the invention may be combined with optional and/or preferred features of another/other embodiment(s) of the invention.

BRIEF DESCRIPTION OF THE DRAWINGS

Additional features and advantages of the present invention are described in, and will be apparent from, the detailed description of the invention and from the drawings in which:

FIGS. 1A and 1B respectively illustrate a front elevation view and a rear elevation view, respectively, of a golf club having a golf club grip of the present invention.

FIG. 2A illustrates a top plan view of the golf club grip along as indicated by arrows A-A in FIG. 1B, while FIG. 2B illustrates a top sectional view of the golf club grip as indicated by arrows B-B in FIG. 2B.

FIG. 8A show a rear elevation view, of a golf club having an golf club grip of the present invention further comprising finger grooves; FIG. 8B shows a top plan view of the golf club grip of FIG. 8A as indicated by arrows A-A in FIG. 8B, while FIG. 8C illustrates a top sectional view of the golf club grip of FIG. 8A as indicated by arrows B-B in FIG. 8A.

DETAILED DESCRIPTION OF THE DRAWINGS

It should be readily apparent to one of ordinary skill in the art that the examples disclosed herein below represent generalised examples only, and that other arrangements and methods capable of reproducing the invention are possible and are embraced by the present invention as set out in the claims.

Figure 1A:
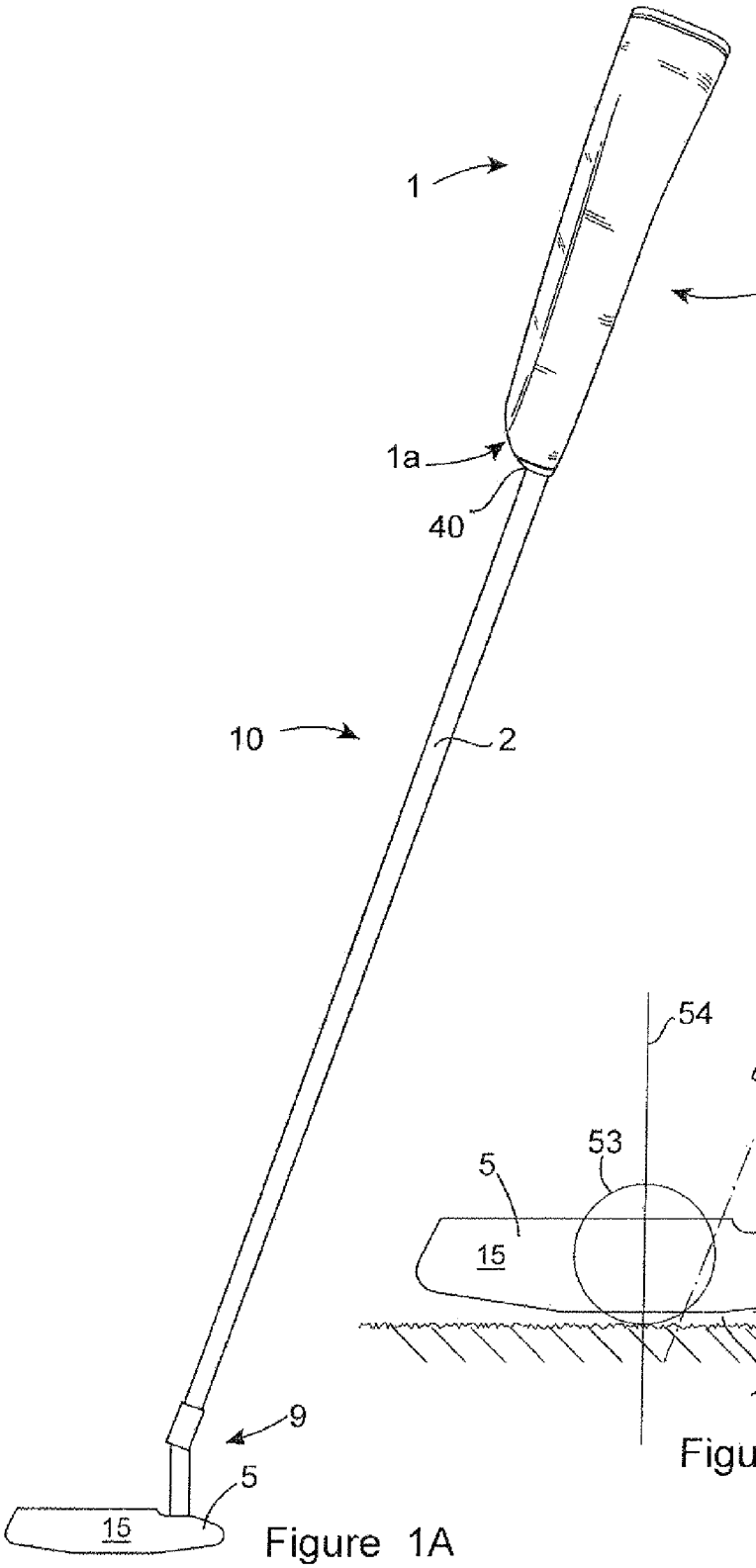
Figures 1B, 2A, 2B:
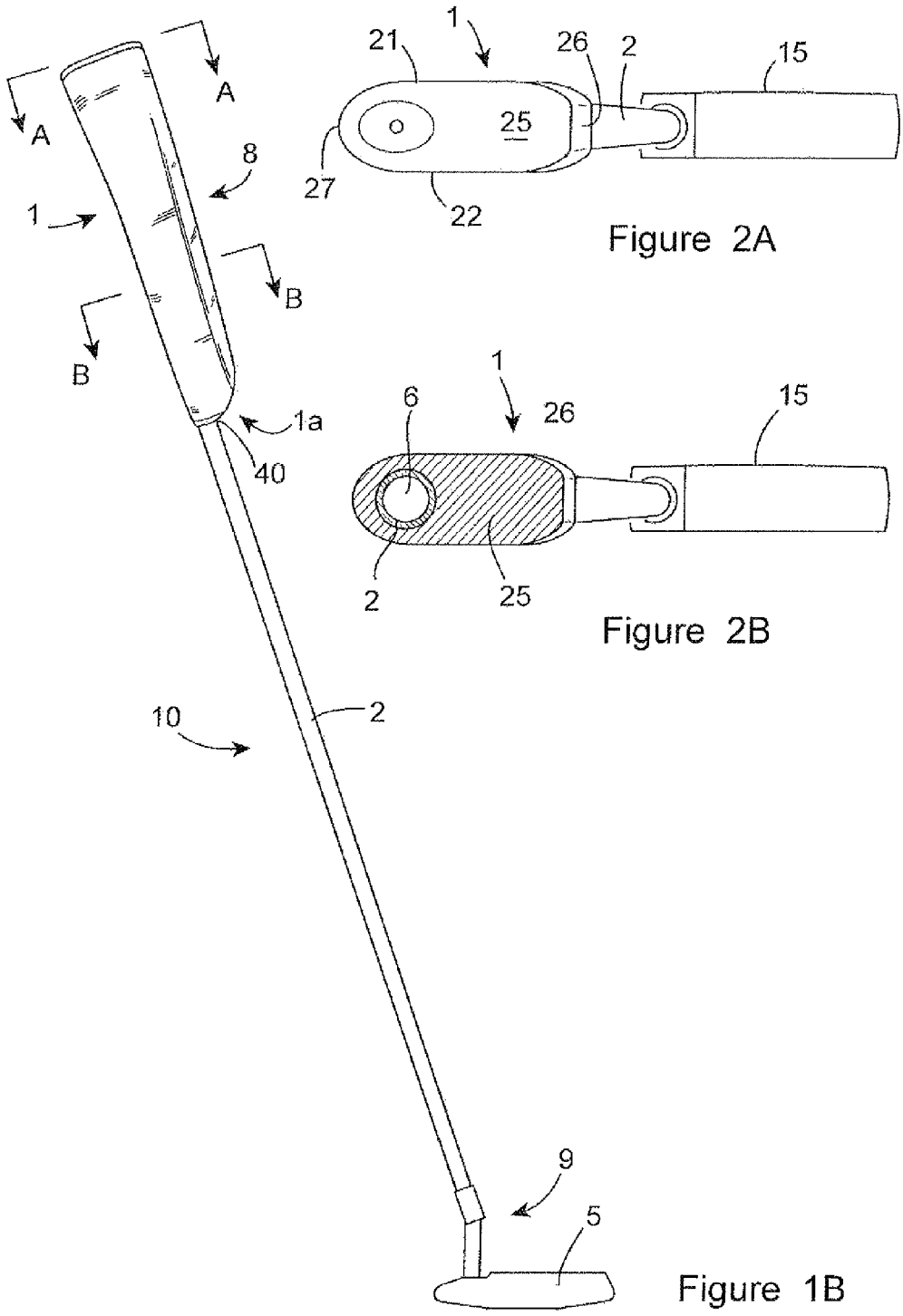

In FIG. 1 there is illustrated: FIG. 1A a front view and FIG. 1B a rear side view of a golf club 10 having a golf club grip according to the present invention. The golf club grip is generally indicated by the reference numeral 1. In the illustrated embodiment, the golf club grip 1 is at an upper (proximal) end 8 of a golf club shaft 2.

Figure 4A:
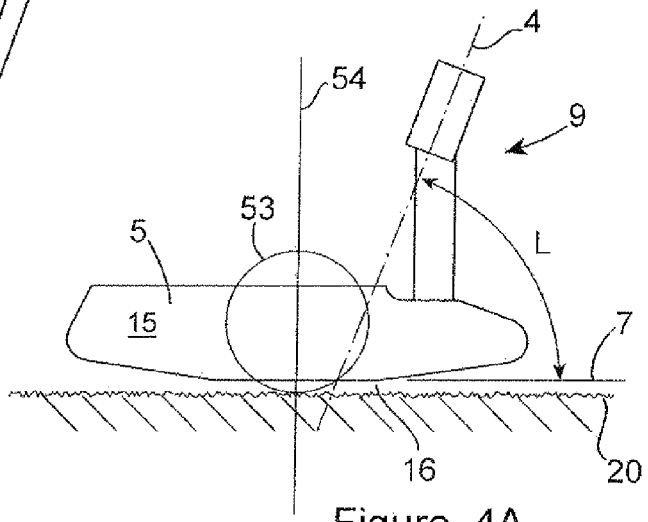
FIG. 4A shows an enlarged view of the club head and part of the shaft, and with the lie angle of the club between the shaft and the club head indicated.

The grip member 1 has a longitudinal bore 6 (see FIGS. 2B and 3) for accommodating the shaft 2. The club 10 has a club head and in particular a club (putting) head 5 at a lower (distal) end 9 thereof with a club (putting) face 15. The club shaft 2 has a longitudinal axis 4 (see FIGS. 3 and 4A). The angle L between the longitudinal axis 4 of the shaft 2 and the (horizontal) plane 7 of the lower surface 16 of the club head 5 is the lie angle. The effective lie angle can be considered to be the angle at which the club shaft is positioned relative to the ground 20 when the plane of the bottom surface of the club head is parallel to the ground 20. The grip 1 of the golf club 10 is not conventional and in particular it is shaped, and the bore 6 is positioned within the grip 1 so that the grip provides an increased effective lie angle L' as illustrated in FIG. 4B.

Figure 3:
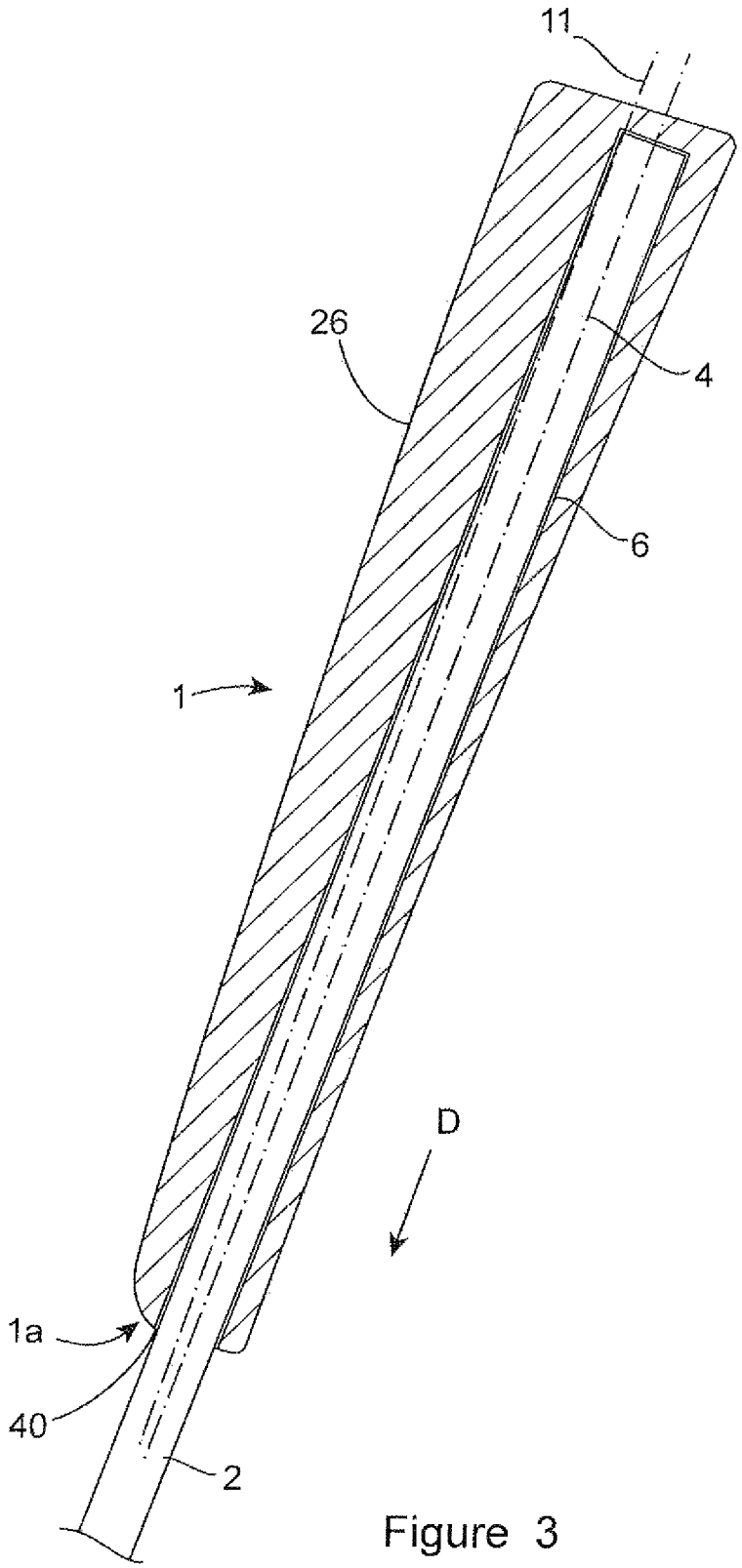
FIG. 3 shows an enlarged sectional view of the golf grip of earlier figures with a central longitudinal axis of the shaft and a central longitudinal axis of the grip shown.
Figure 4B:
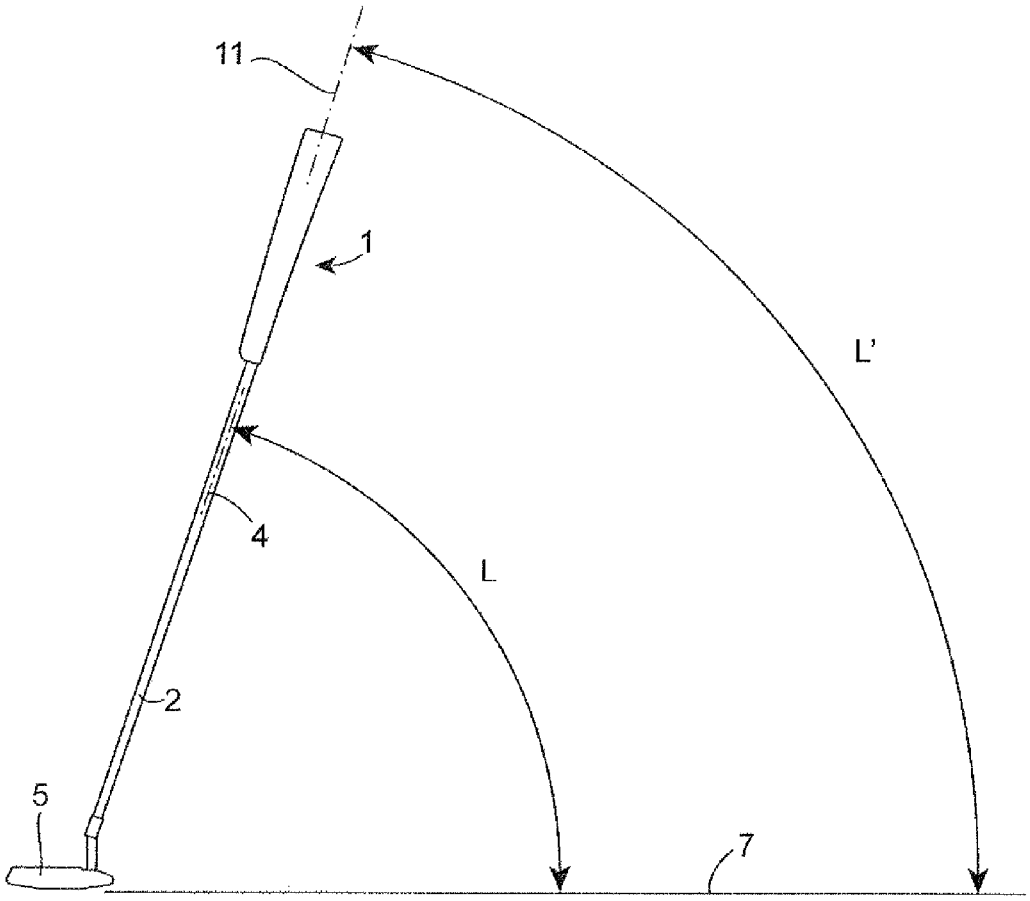
FIG. 4B shows the entire club and the lie angle of FIG. 4A but additionally showing the effective lie angle created by using a golf grip of the invention of the type shown in preceding Figures.

FIG. 3 shows how this has been achieved in the embodiment shown. In particular the (centre) longitudinal axis of the bore 6 and the (centre) longitudinal axis 11 of the grip 1 are arranged to converge in a direction D (down the shaft 2 and) toward the head 5 of the club 10 as clearly illustrated in FIG. 3. This means that even though the lie angle L between the club head and the shaft has not been altered and remains as it was, the user experiences an effective lie angle L' which is greater than the actual lie angle of the club. This is because conventional golf grips are not arranged to increase the lie angle of the shaft and with a conventional grip the user will thus experience the lie angle L. The effective increase in the lie angle experienced by the user results in a dramatic improvement in the accuracy of a user using the club (as is clearly demonstrated by the test results given below). It is desirable that a golf ball 53 (shown in outline only) is hit by the head 5 along a central plane 54 of the face 15 of the club 10. The present invention will be shown to improve the accuracy of a user trying to achieve such a desirable strike of the golf ball 53.

The lie angle L is the angle formed by the shaft 2 and sole of the putter head 5 when the putter is held in a neutral position at address, that is, when the putter head is parallel to a flat surface. The lie angle L of the shaft 2 is generally between 71 degrees and 72 degrees. The limit of the lie angle is generally between about 67 degrees to about 75 degrees, with a maximum lie angle of about 75 degrees to about 76 degrees.

The standard lie angle for most commercially available putters is between 70 and 72 degrees. The lie angle is sometimes defined as the angle achieved with a certain offset from 90 degrees, for example 19 degrees offset (that is, a lie angle of 71 degrees). The minimum offset allowable by the Rules of Golf, as maintained by the United States Golf Association (USGA) and the Royal & Ancient Golf Club of St. Andrews, Scotland, is 10 degrees (that is, the shaft having a maximum lie angle of 80 degrees).

The shaft-receiving bore 6 is defined by and in the grip 1. As can be seen from the drawings the bore 6 is offset from a central position of the grip and is positioned toward the rear of the grip (the side of the grip which is opposite to the side on which the club head extends).

Figure 5A:
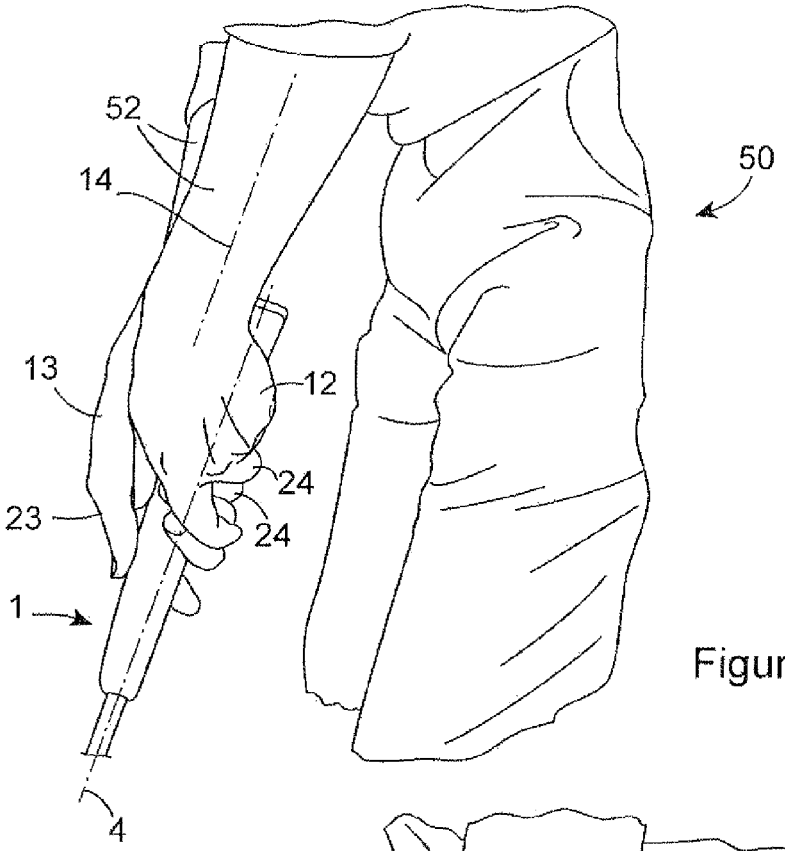
FIG. 5A and FIG. 5B illustrate the effect of utilising a golf grip of the present invention on a user's swing position, in FIG. 5A due to the grip of the invention the forearms are substantially aligned with the longitudinal axis of the shaft whereas in FIG. 5B with a conventional grip the forearms are misaligned with the longitudinal axis of the shaft.
Figure 5B:
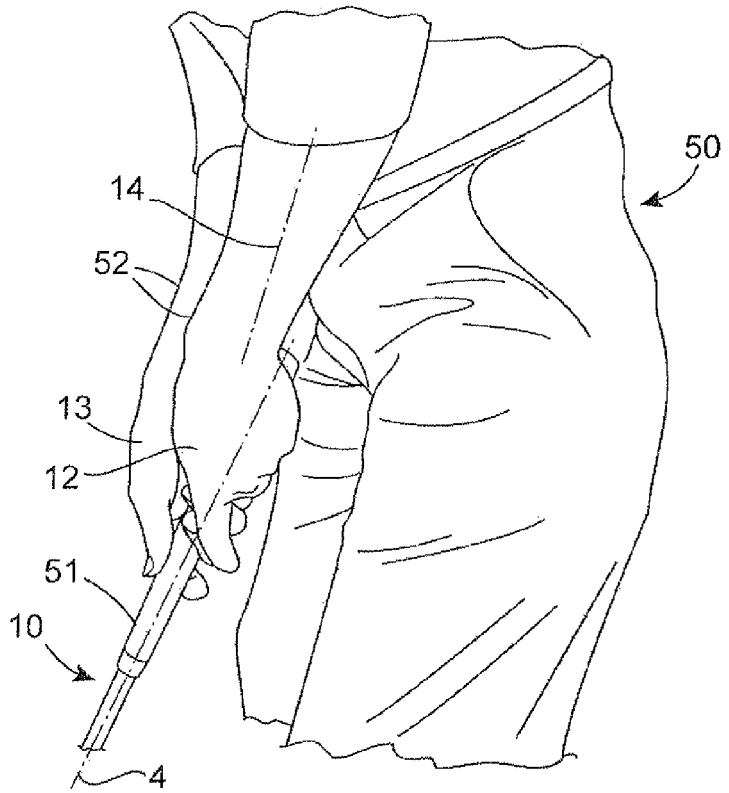

The grip 1 is generally oversized and is configured to fit and fill the hands 12,13 of the golfer 50 as shown in FIG. 5A. FIG. 5B shows the same club 10 held by the same golfer 50 but with a conventional grip 51. The improvement in position achieved by the present invention is thought to lie in the fact that when using a grip of the present invention a longitudinal plane 14 of the forearms 52 is substantially parallel to the longitudinal axis 4 of the shaft 2. This occurs naturally when gripping and the arm position is improved without any instruction. Furthermore as again can be seen from the FIG. 5A the forearms are substantially aligned with each other. In contrast with a conventional grip 51 it can be seen that the forearms 52 are not aligned. Furthermore the longitudinal plane 14 of the forearms 52 is not parallel to the longitudinal axis 4 of the shaft 2. This means that with a grip 1 of the present invention a user is likely to take up the position of FIG. 5A compared to when they use the conventional grip. In the case of a conventional grip they are more likely to take up the position shown in FIG. 5B. The dimensions of the grip 1 and the increased effective lie angle L' together act to align the forearms 52 of a user with each other along the same plane and said plane is parallel to a longitudinal axis of the shaft in a gripping position of the club. This better alignment is thought to be the reason for the substantially improved accuracy of a user using the grip 1 of the present invention.

Figure 6A:
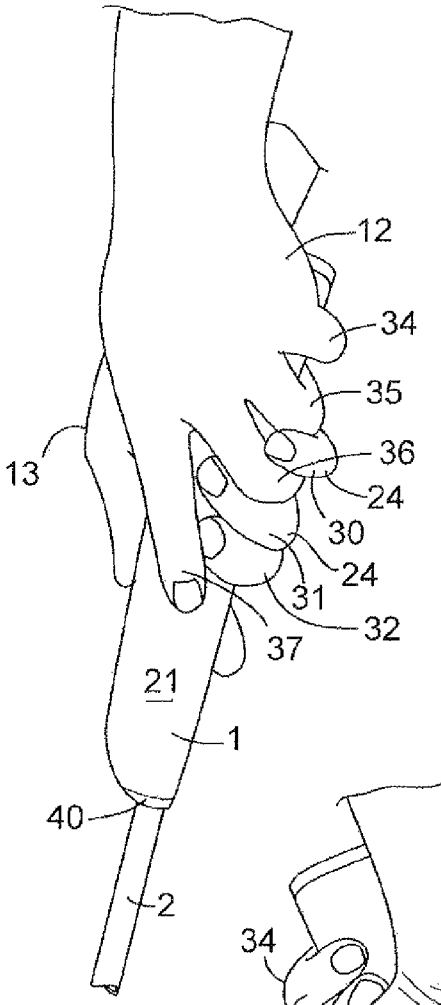
FIGS. 6A-6C respectively show close-up partial views of the hands of a user gripping a grip of the invention from a front side, side on and rear side.
Figure 6B:
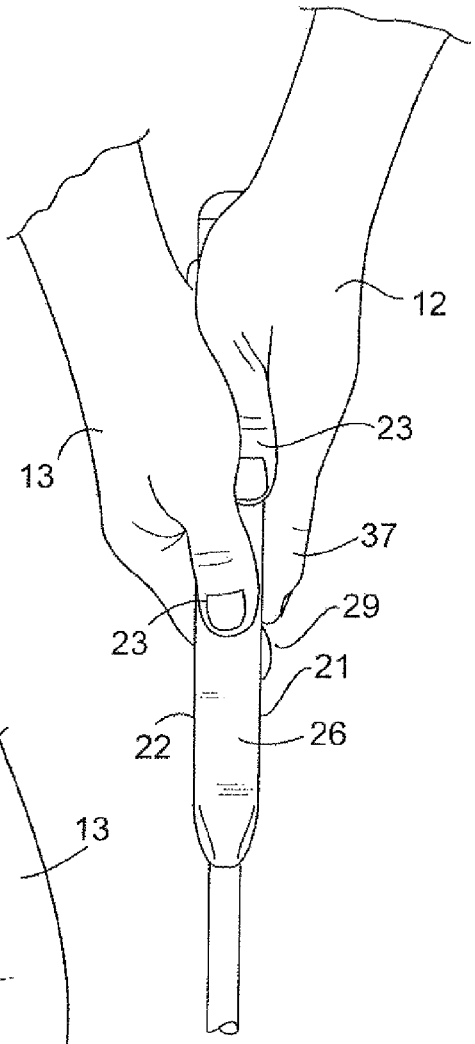
Figure 6C:
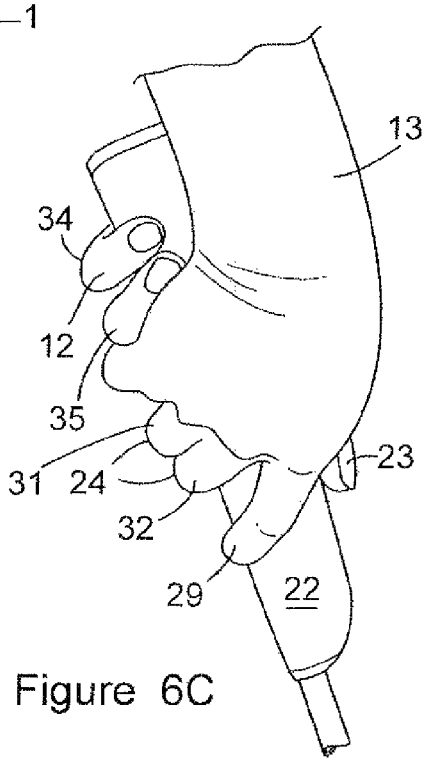
Figure 7:
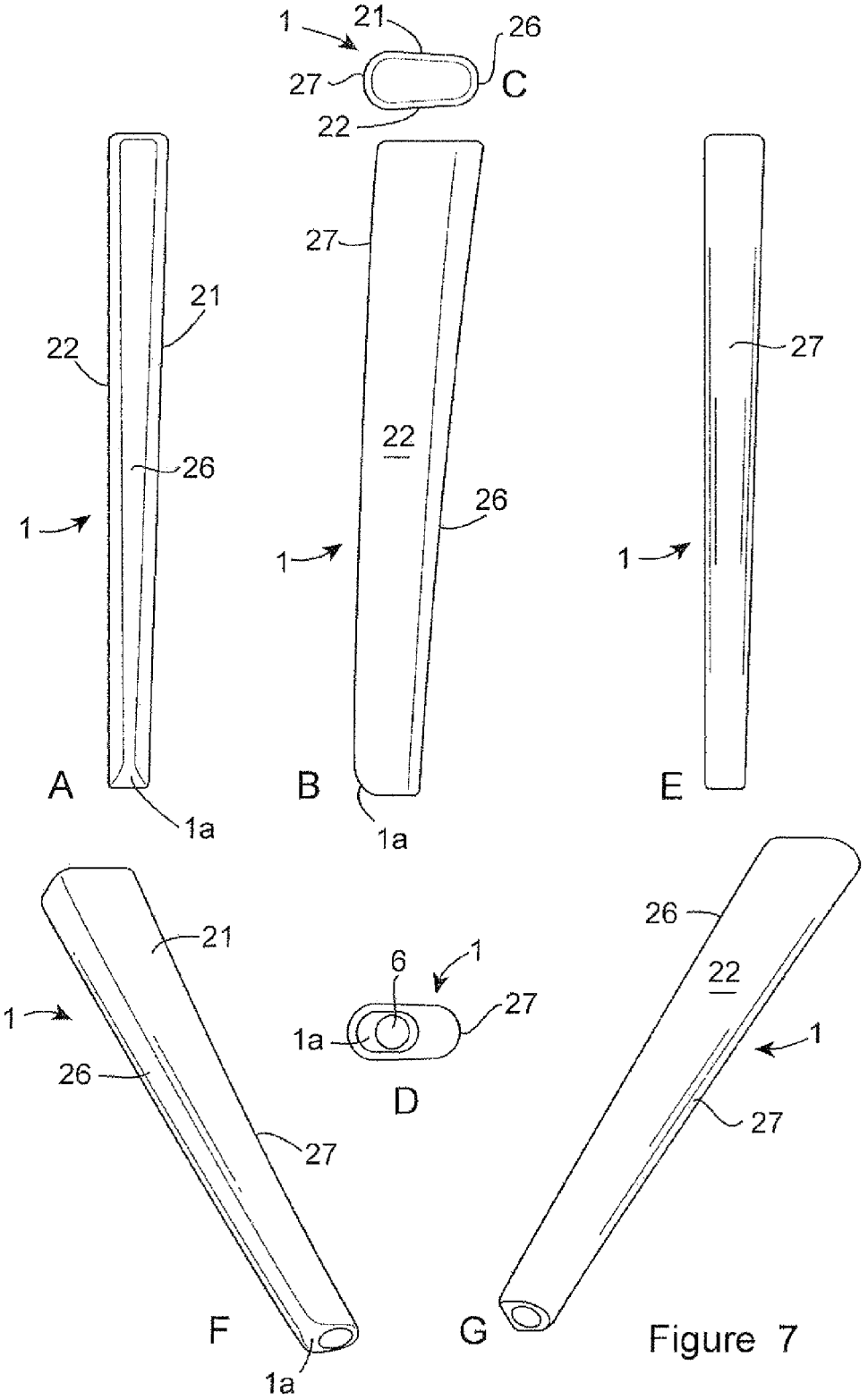
FIGS. 7A-G respectively show front, side, top, underneath and rear elevations and a first perspective view (from the front and side) and a second perspective view (from the rear and side) of an embodiment which is very similar to that of FIGS. 1 to 6.

The grip 1 is also dimensioned to fill the palm of the hands between the thumb 23 and the knuckles 24 at the midfinger position of the hand. FIGS. 6A to 6C illustrate similar and alternative views to those shown in FIGS. 5A and 5B with a right-handed golfer holding the grip 1 of the present invention. The left hand 12 and right (leading) hand 13 are positioned on the grip 1 such that both palms are facing each other, the hands 12,13 in a neutral position and parallel to the putter face 15. Neutral in this respect means that the position of the hands is aligned so that swinging of the arms does not cause any turning of the hands. The neutral positioning of the hands 12,13 is a result of the shape of the grip 1 and the increase in the effective lie angle. As a result of the neutral positioning of the hands 12,13 on the grip 1, thumbs 23,24 are automatically adopt a position on the grip 1 where they are on flat surface 26 and pointing straight down the centre of the grip 1 and the shaft 2 in the direction of club head 5.

The grip 1 is configured to fit and fill the hands 12,13 of the golfer. The grip fills out the palm and finger joints and as a result lines up the hands with the forearms. The side 21 of grip member 1 is held comfortably by fingers 30,31,32 of hand 13 and side 22 by fingers 34,35,36 of hand 12 and finger 37 of hand 13 rest on side 21 with finger 24 gripping the other hand. The tips of fingers 34,35,36 rest comfortably on side 22 of grip member 1. Thumbs 23 are in a central position pointing down the centre of the shaft 2.

One skilled in the art will understand that the positioning of the hands 12,13 will be reversed for a left-handed golfer (where the left hand is the leading hand) who will also use a putter with the striking face facing in the opposite direction. Overall the positioning of hands achieved for a left-hand golfer is the same as that of a right-handed one. The grip of the invention does not need reconfiguration for different handedness.

It can be seen from the Figures (see for example FIG. 2A and 2B) that the grip 1 is elongate in cross-sectional shape with a greater part 25 of the grip 1 extending on front side of the shaft 2 (the same side on that on which the club head 5 extends). Desirably at least that greater part 25 of the grip is resiliently deformable under (normal golf club gripping pressure) manual gripping by a user. The elongate cross-sectional shape is substantially that of an ellipse with flat sides 21,22 and a flat front surface 26. The grip 1 (see for example the front surface 26 best seen in FIG. 3) tapers inwardly in a direction down the shaft and on the same (front) side of the shaft on which the club head 5 extends.

At the lower end 1*a* end of the grip 1, where the shaft 2 exits the grip 1 and in the direction of arrow A, the grip member 1 curves inwardly to converge at a point 40 where the shaft 2 exits.

The grip 1 may be at least partially hollow to allow for more deformation upon gripping by a user. For example the part 25 of the grip 1 may be made of a suitable resiliently deformable material and/or be at least partially hollow.

FIGS. 7A-G show views from different vantage points of a golf grip 1 of the present invention which is similar in construction to that of the earlier Figures but of a slightly more streamlined aesthetic appearance. Reference numerals have been used consistently with earlier figures to indicate the same parts.

Figures 8A, 8B, 8C:
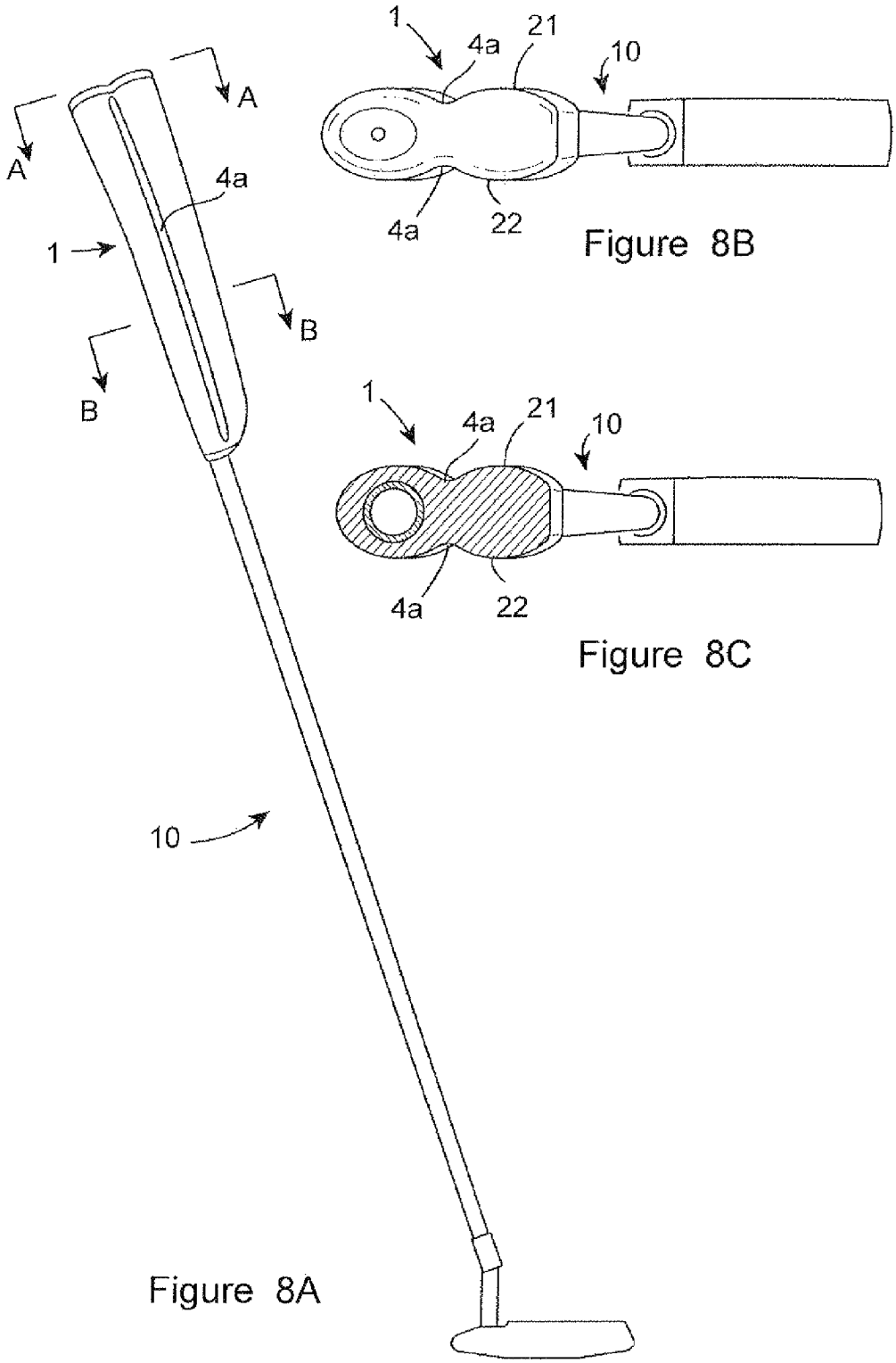
Figure 9A:
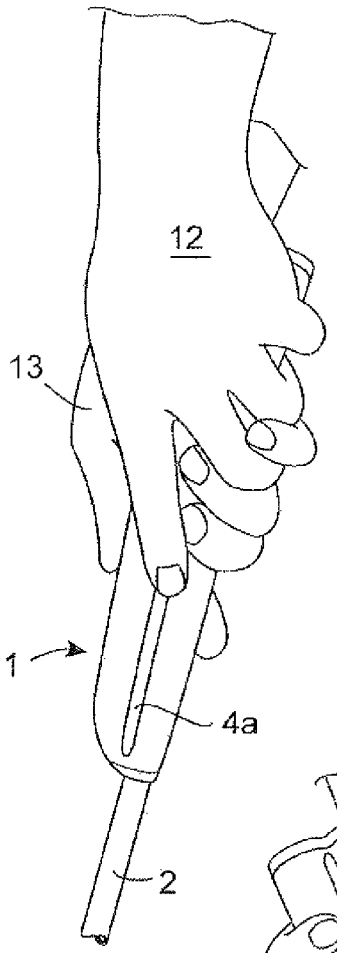
FIGS. 9A, 9B, and 9C illustrate a front view, a side view, and a rear view, respectively, of the golf grip of FIGS. 8A-C being held by a user.
Figure 9B:
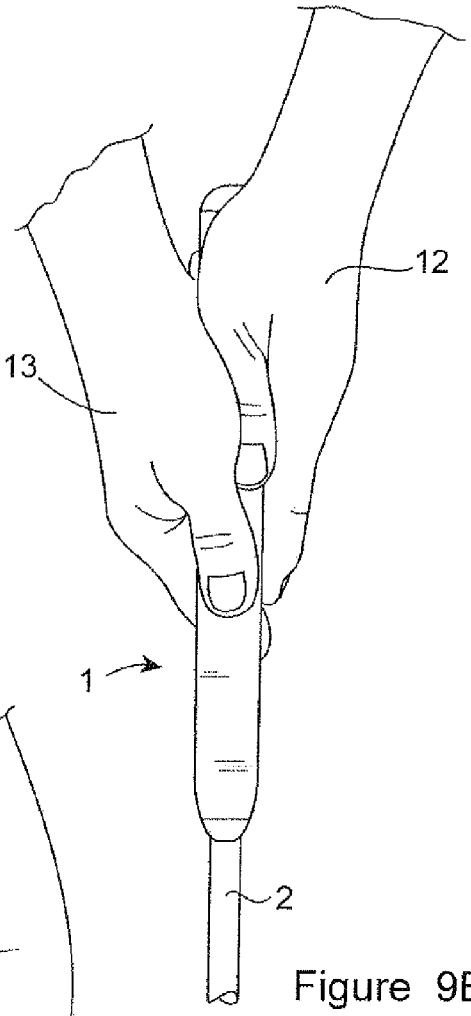
Figure 9C:
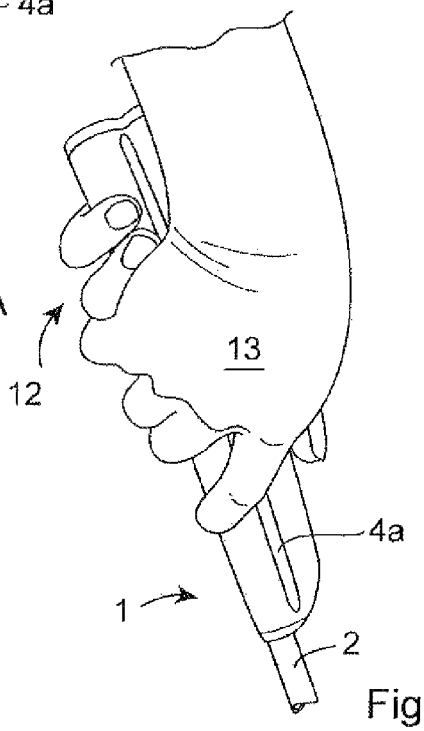

FIGS. 8A to FIG. 8C illustrates a grip 1 of the present invention which is the same as that described for FIGS. 1-6. Reference numerals have been used consistently with earlier figures to indicate the same parts. FIG. 8A shows a rear view while FIGS. 8B and 8C show the grip 1 from the perspective of arrows A and cross-sectional arrows B respectively. FIGS. 9A-C show the grip 1 being held in the same way as FIGS.

6A-C. The sole difference between the grip 1 and the earlier grip is the presence of (elongate) longitudinal finger grooves 4*a* at an intermediate finger position on opposing sides 21,22 of the grip 1. The grooves 4*a* allow for better hand positioning and imparts a substantially overall Figure of 8 outline shape in cross-section. In particular groove 4*a* accommodates the tops of fingers of the hand 13 on one side and those of hand 12 on the other. The grooves run from top to bottom along the grip and desirably run along at least that part of the grip which is held by the hands.

The dimensions of the grip 1 (as shown in FIGS. 1 to 9) are desirably as follows: The length of the grip may range from about 20 cm to about 40 cm, preferably from about 22 cm to about 30 cm, more preferably from about 24 cm to about 28 cm. It is desirable that the grip length is about 26.5 cm. The longer cross-sectional diameter of the grip (major axis) desirably is: (i) at the top of the grip member from about 3.90 cm to about 4.4 cm, preferably from about 3.95 cm to about 4.35 cm, more preferably from about 4.0 cm to about 4.3 cm, and desirably about 4.27 cm; (ii) midway down the grip from about 3.3 cm to about 3.7 cm, preferably from about 3.5 cm to about 3.65 cm, and desirably about 3.6 cm; and (iii) at the lower end 40 where the shaft 2 exits the grip member from about 2.3 cm to about 3.0 cm, preferably from about 2.5 cm to about 2.8 cm, and desirably about 2.7 cm.

The diameter of the grip 1 at its widest is within the cross-sectional dimensions permitted by Official Golf Rules maintained by the United States Golf Association (USGA) and the Royal & Ancient Golf Club of St. Andrews, Scotland. The Rules state that ". . . cross-sectional dimensions measured in any direction must not exceed 1.75 inches (44.45 mm)" (4.445 cm).

The diameter along the transverse (minor) axis of the grip is: (i) at the upper end of the grip member from about 2.30 cm to about 2.70 cm, preferably from about 2.35 cm to about 2.60 cm, and desirably about 2.43 cm; (ii) midway down the grip from about 1.90 cm to about 2.20 cm, preferably from about 2.00 cm to about 2.15 cm, and desirably about 2.10 cm; and (iii) at the lower end 40 where the shaft 2 exits the grip member from about 1.60 cm to about 1.85 cm, preferably from about 1.65 cm to about 1.80 cm, and desirably about 1.734 cm.

Where the shaft 2 occupies a longitudinal bore 6 of the grip member, the distance from (i) the front surface of the shaft to the front of the grip member at the upper end thereof is from about 1.90 cm to about 2.30 cm, preferably from about 2.00 cm to about 2.20 cm, and desirably about 2.1 cm; (midway down the grip is from about 1.60 cm to about 1.85 cm, preferably from about 1.70 cm to about 1.80 cm, and desirably about 1.80 cm; and (iii) at the lower end 40 where the shaft 2 exits the grip member is from about 0.75 cm to about 1.00 cm, preferably from about 0.85 cm to about 0.95 cm, and desirably about 0.9 cm.

The distance from the back surface of the shaft to the back of the grip member at the upper end thereof is from about 0.50 cm to about 0.85 cm, preferably from about 0.60 cm to about 0.75 cm, and desirably about 0.70 cm and at the lower end where the shaft 2 exits the grip member is from about 0.40 cm to about 0.60 cm, and desirably about 0.5 cm. This produces the tapered appearance of the grip of the present invention. Furthermore, the width of the front upper and lower flat faces is from about 0.40 to about 0.80 cm, preferably from about 0.50 to about 0.70 cm, and desirably about 0.60 cm.

Data Generated by Testing a Grip Shown in FIGS. 8A-C.

The following exemplifies the advantages of the grip 1 of the present invention over a grip of the prior art. A novice golfer was tested using a grip commonly used on a putter (results shown in FIG. 10) and the grip 1 of the present invention (results shown in FIG. 11 and FIG. 12). In particular the putter used was a Never Compromise Milled Series 2 (Putter 1), an Odyssey 2-Ball (Putter 2) and a Dave Hicks DH-10 Ultimate (Putter 3).

Tests were carried out using the SAM PuttLab as a measurement tool (see: http://www.samputtlab.com/). The SAM PuttLab is an analysis and training system based on an accurate ultrasound measurement, covering 28 parameters of the putting stroke. The tests were carried out in identical surroundings and the distance of each putt was 3 meters. There was no verbal instruction given to the novice golfer during the testing. The objective measurements of the putting stroke measured were, as shown in the FIGS. 10-12, in which the respective illustrations show (a) putter face position at address, and (b) at impact (c) path direction, (d) impact spot, and (e) rate of club-head rotation.

TABLE 1

Figure 10:
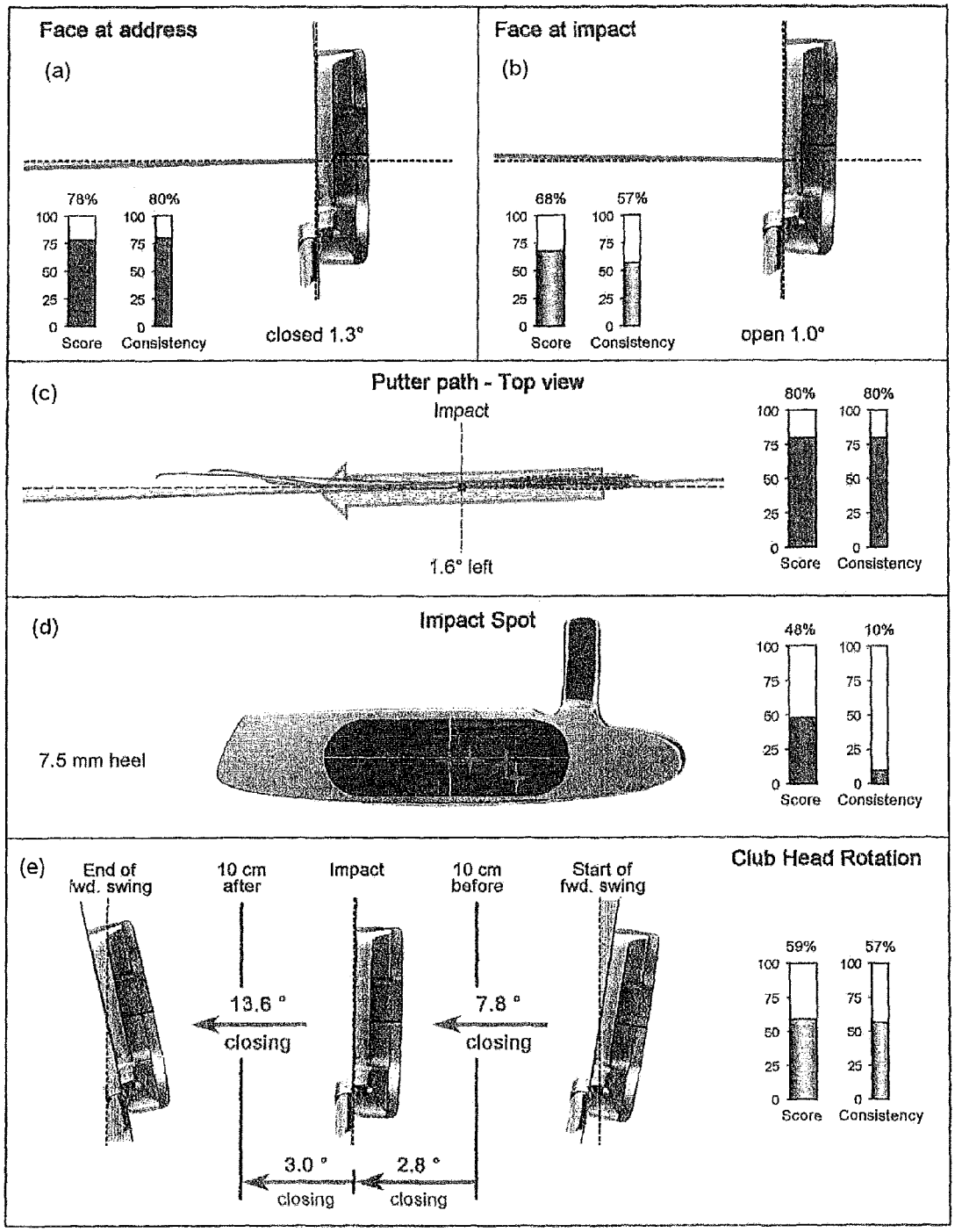
FIGS. 10 through 18 show the results of tests carried out on putting performance using a grip of the prior art or a grip of the invention as analysed by the SAM PuttLab measurement tool and as described in more detail below.
Figure 11:
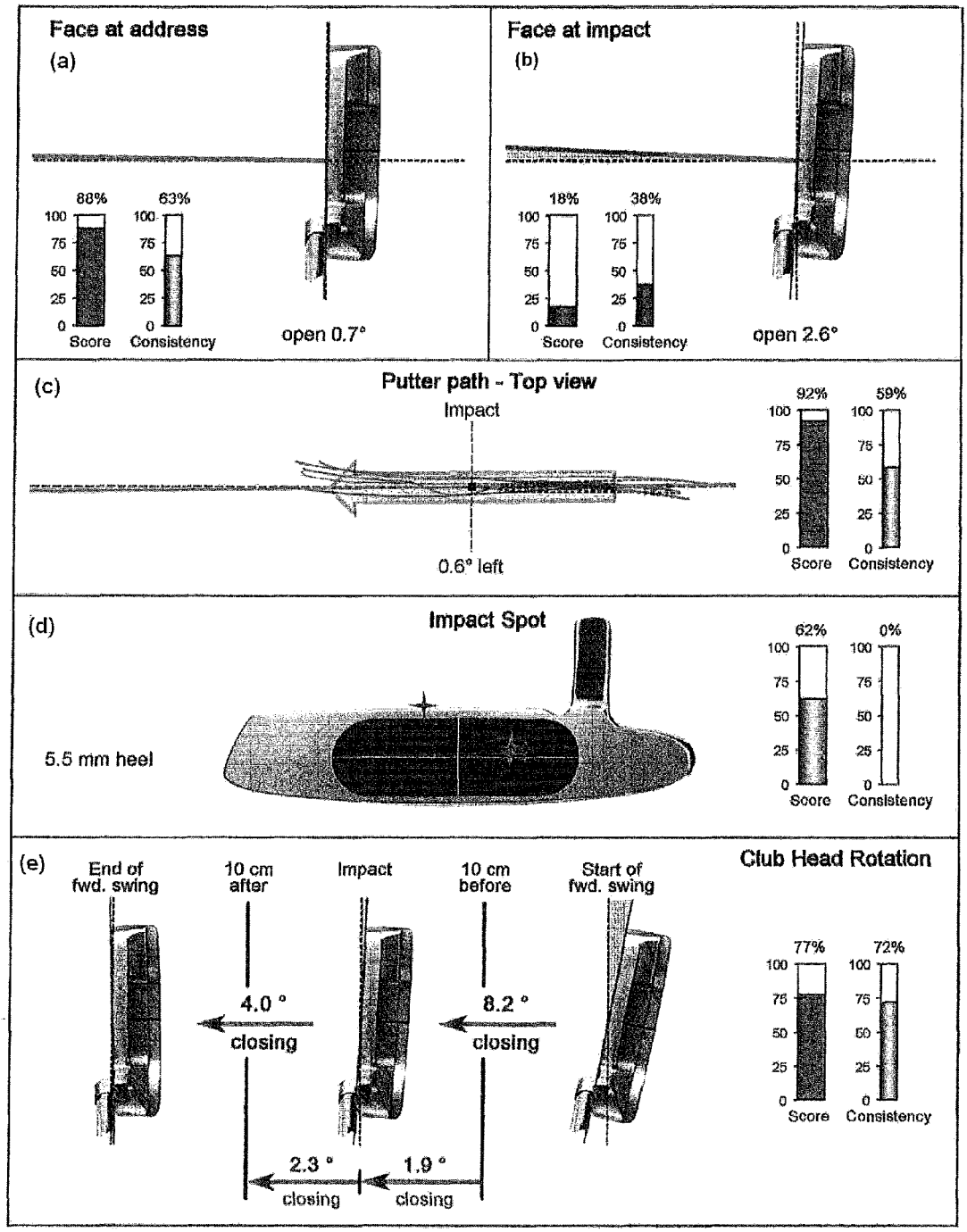
Figure 12:
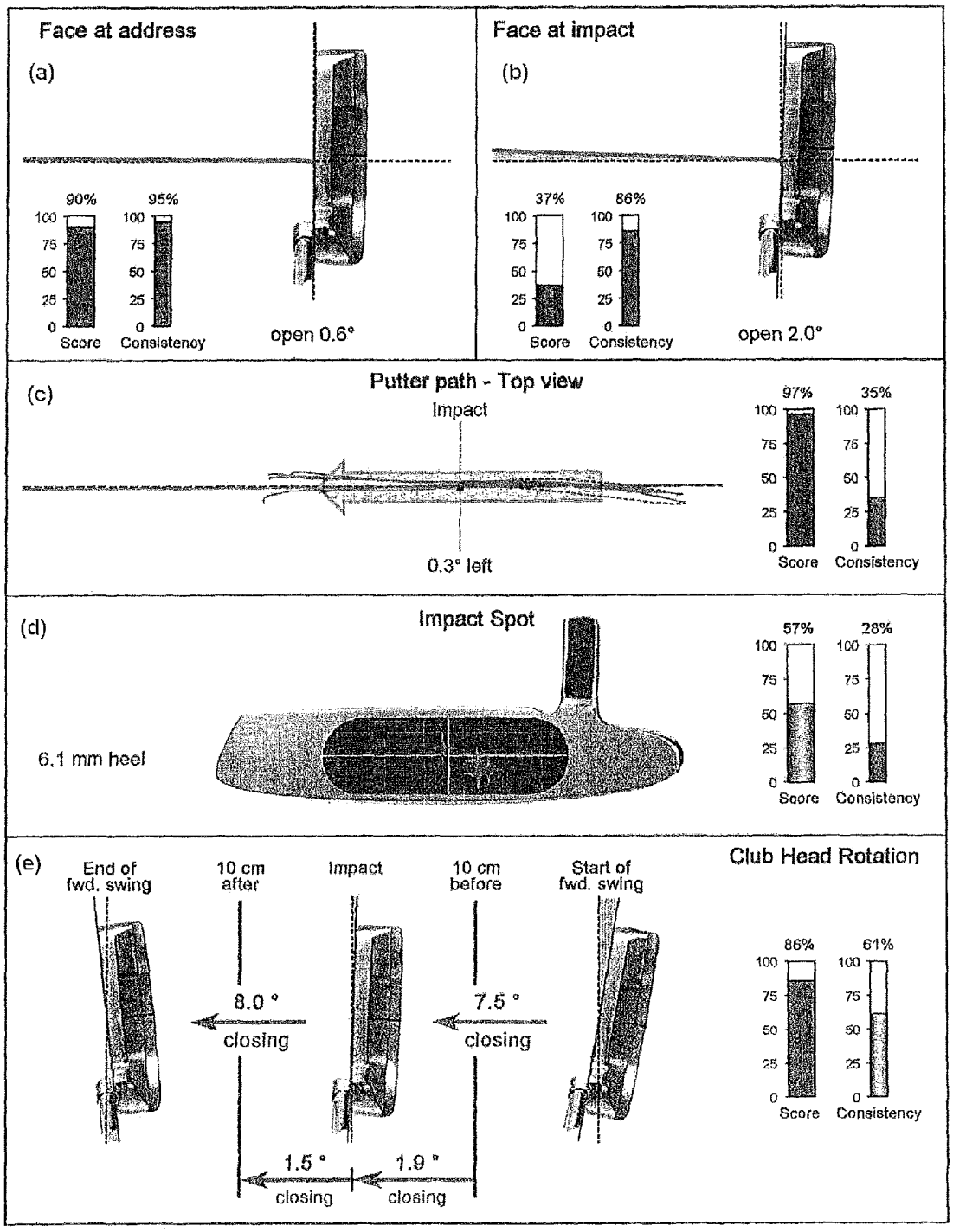

Results from tests carried out using the SAM PuttLab analysis system shown in FIGS. 10-12 are tabulated. The lie angle is the angle between the bottom or sole of the club head and the shaft. There were 5 putts for each test and the distance of each putt was 3 meters. Each putt was scored and a consistency rating was given for each measurement in each of the three tests were given.

| Grip Type | Putter 1 Standard Grip | Putter 2 With Grip of Invention | Putter 3 With Grip of Invention |
|---|---|---|---|
| Club Length (cm) | 88.9 | 88.9 | 78.7 |
| Lie Angle | 71° | 71° | 75° |
| Effective Lie Angle | 71° | 75° | 79° |
| Face Position | | | |
| At Address | Closed 1.3° | Open 0.7 | Open 0.6° |
| At Impact | Open 1.0° | Open 2.6° | Open 2.0° |
| Putter Path | 1.6° left | 0.6° left | 0.3° left |
| Rotation | | | |
| 10 cm Before | 7.8° closing | 8.2° closing | 7.5° closing |
| At/After Impact | 2.8° closing/3.0° closing | 1.9° closing/2.3° closing | 1.9° closing/1.5° closing |
| 10 cm After | 13.6° closing | 4.0° closing | 8.0° closing |
| *Overall Average Score | 66.5% | 67.4% | 73.4% |

*The overall Average Score is an average of the score and consistency rating given for each measurement and assess the golfer's overall performance.

For the first test as illustrated in FIGS. 10*a* to 10*e*, using a standard golf grip on the first putter, the novice golfer scored an average of 66.5% (as averaged and set out in Table 1 above). When the novice golfer carried out the same test using the grip of the present invention with a second putter as illustrated in FIGS. 11*a* to 11*e*, the average score increased to 67.4%, with a 12% improvement in swing path, a 14% improvement in the impact spot test, and an 18% improvement in the club-head rotation. For the third test the novice golfer used the grip of the present invention and a putter custom fitted to the golfer's comfort (that is, the length of the putter shaft is selected based on the comfort for the golfer, technique, length of arms, and the like. While height and the degree of hip hinge are a factor in determining the length of a putter, such factors do not determine the overall length. Length is a personal preference.) As illustrated in FIGS. 12*a* to 12*e*, the overall average score increased to 73.4%, with a 17% improvement in swing path, a 27% improvement in club-head rotation, and a 9% improvement in the impact spot test when compared to the test using a standard golf grip of the prior art. The results of this test clearly show a significant improvement in the golfer's ability to perfect the club-head path and create an ideal club-head rotation, which are both crucial elements and recognised habits of effective and successful golfers/putters. It is thought that the major improvement is due to the change in effective lie angle.

Data Generated by Testing a Grip Shown in FIGS. 1 to 6

Figure 13:
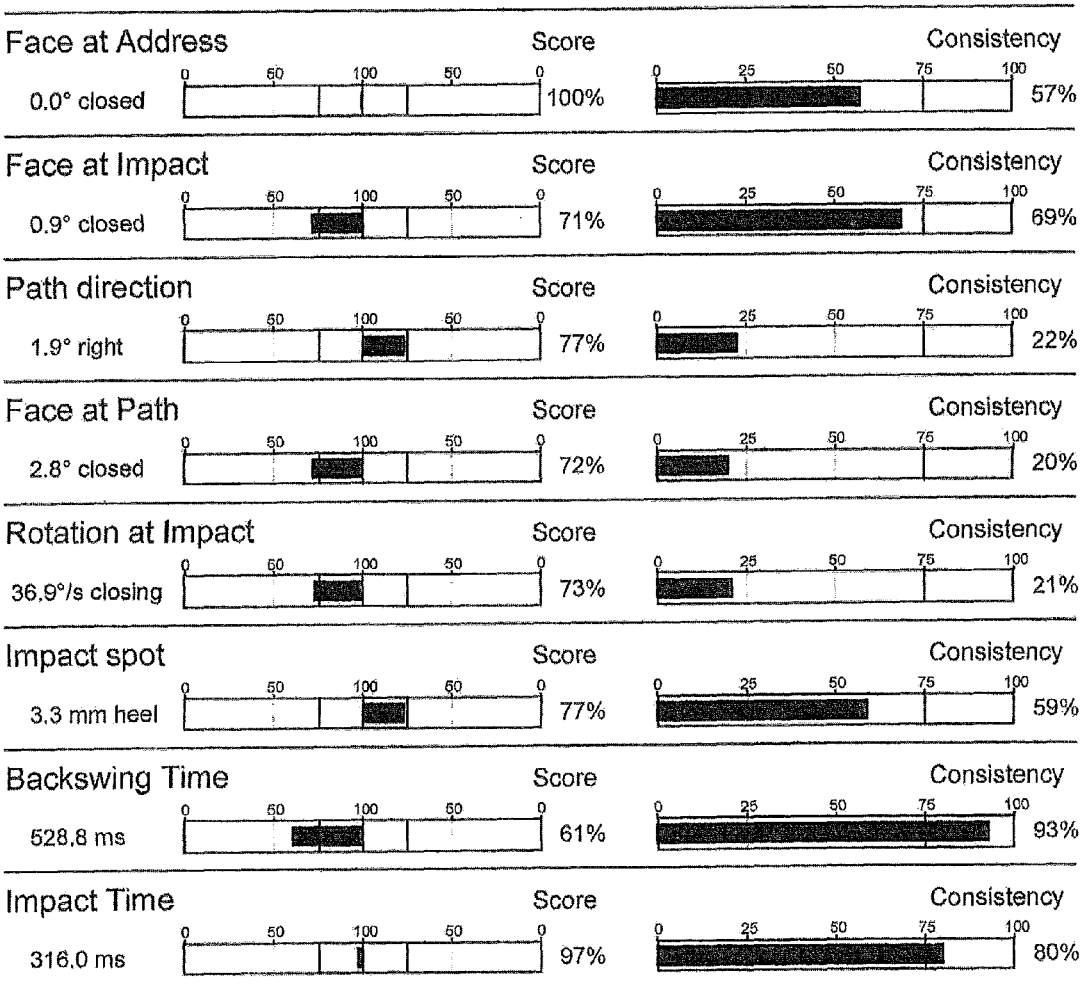
Figure 14:
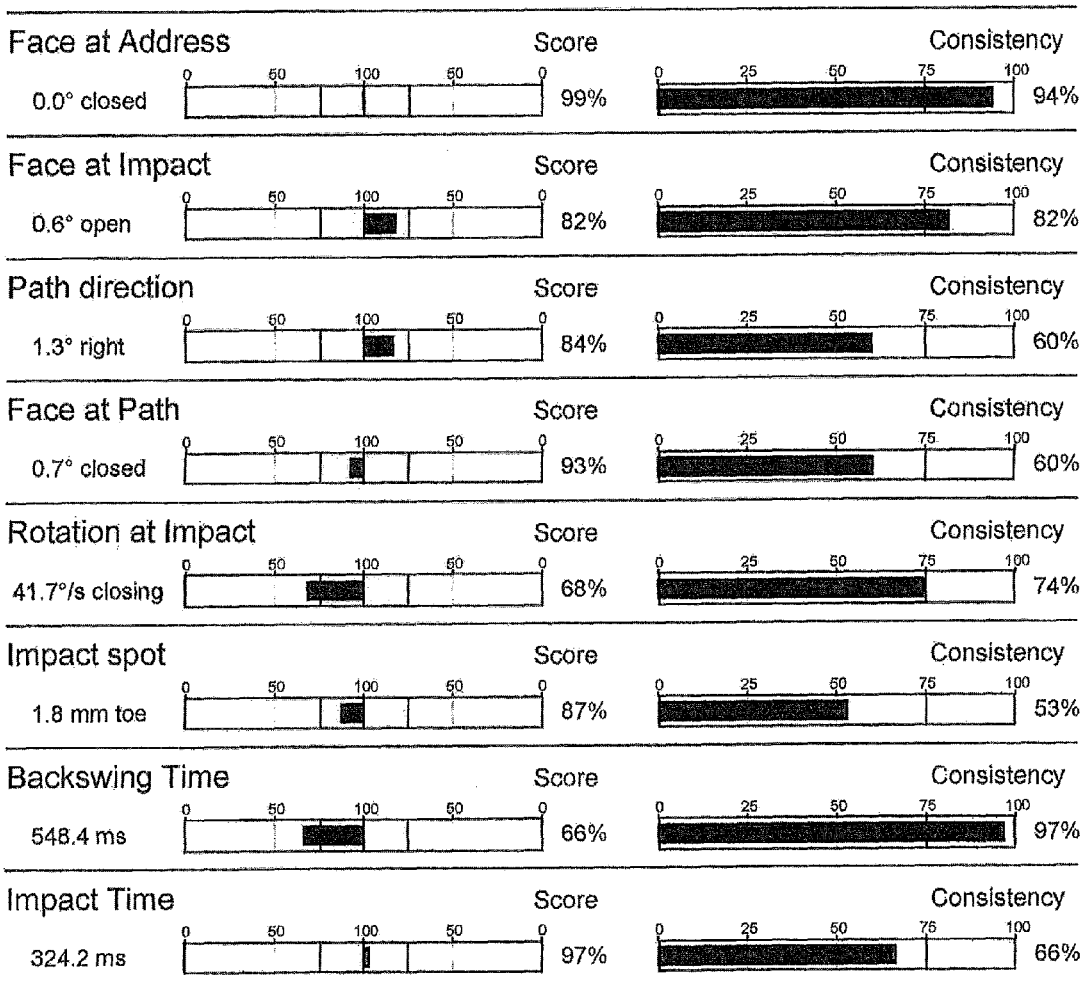
Figure 15:
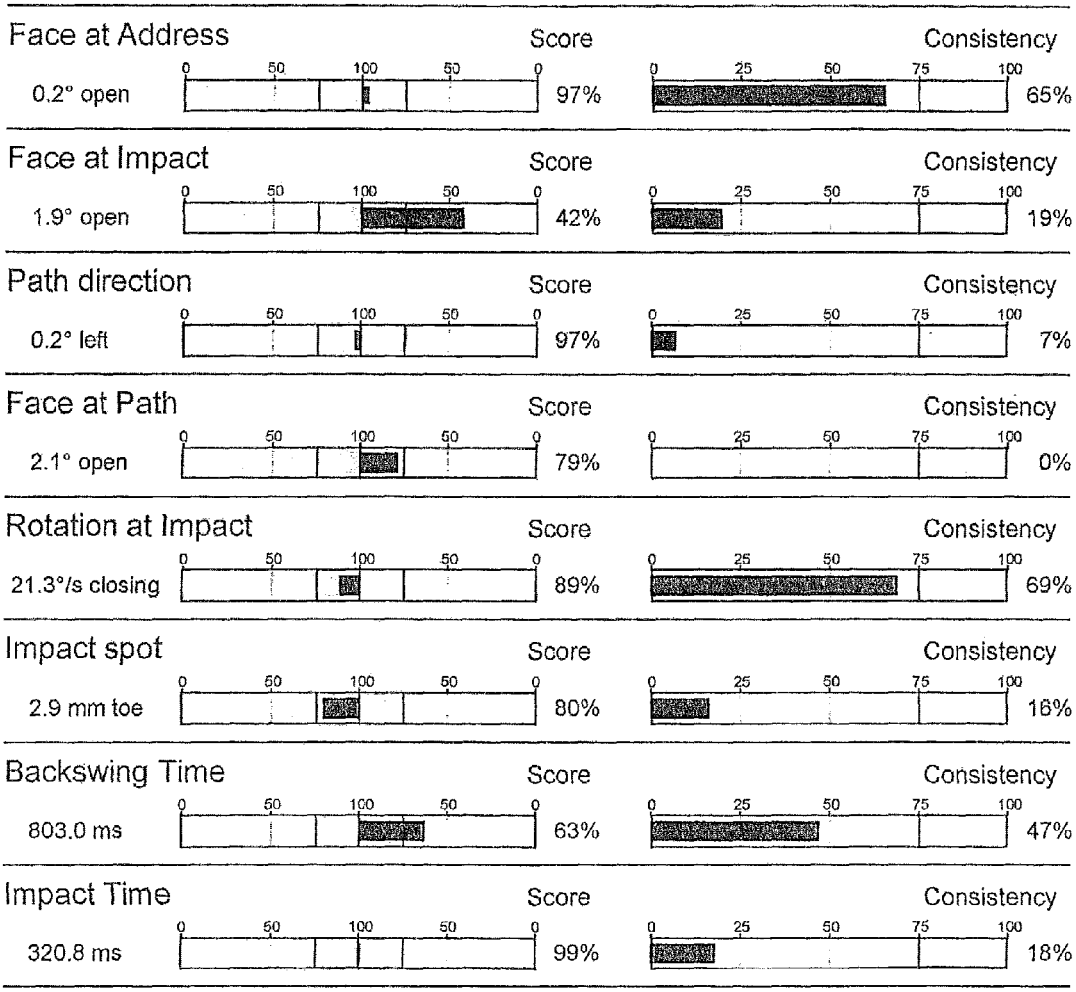
Figure 16:
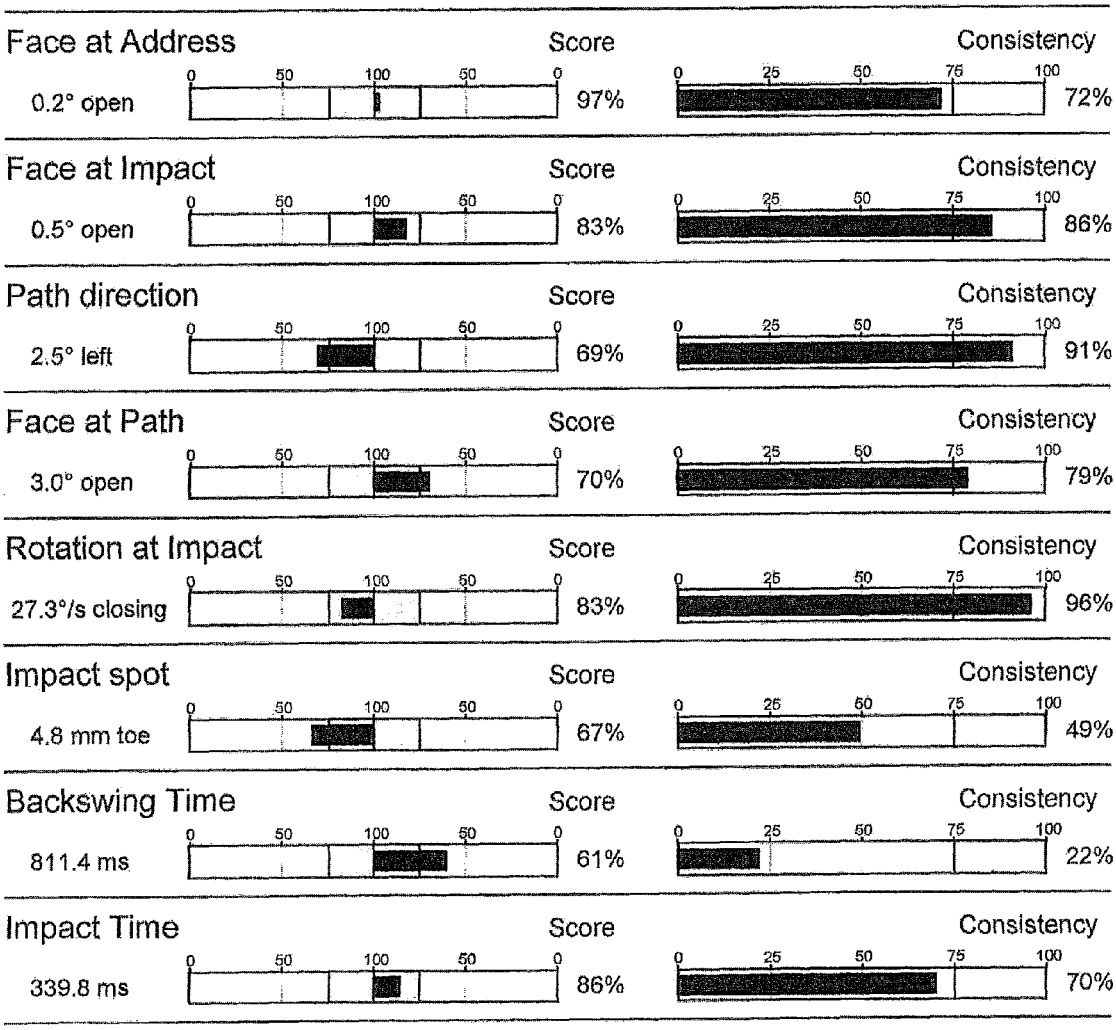
Figure 17:
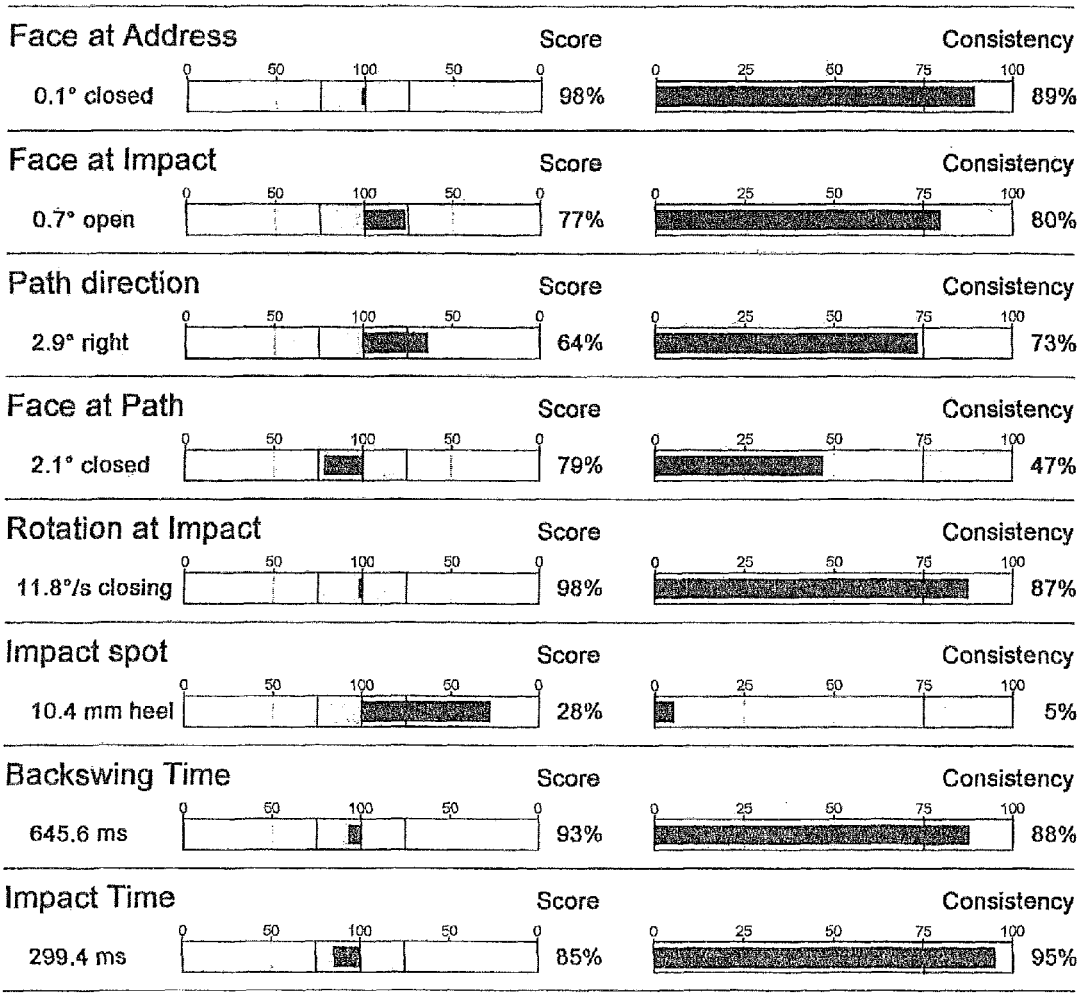
Figure 18:
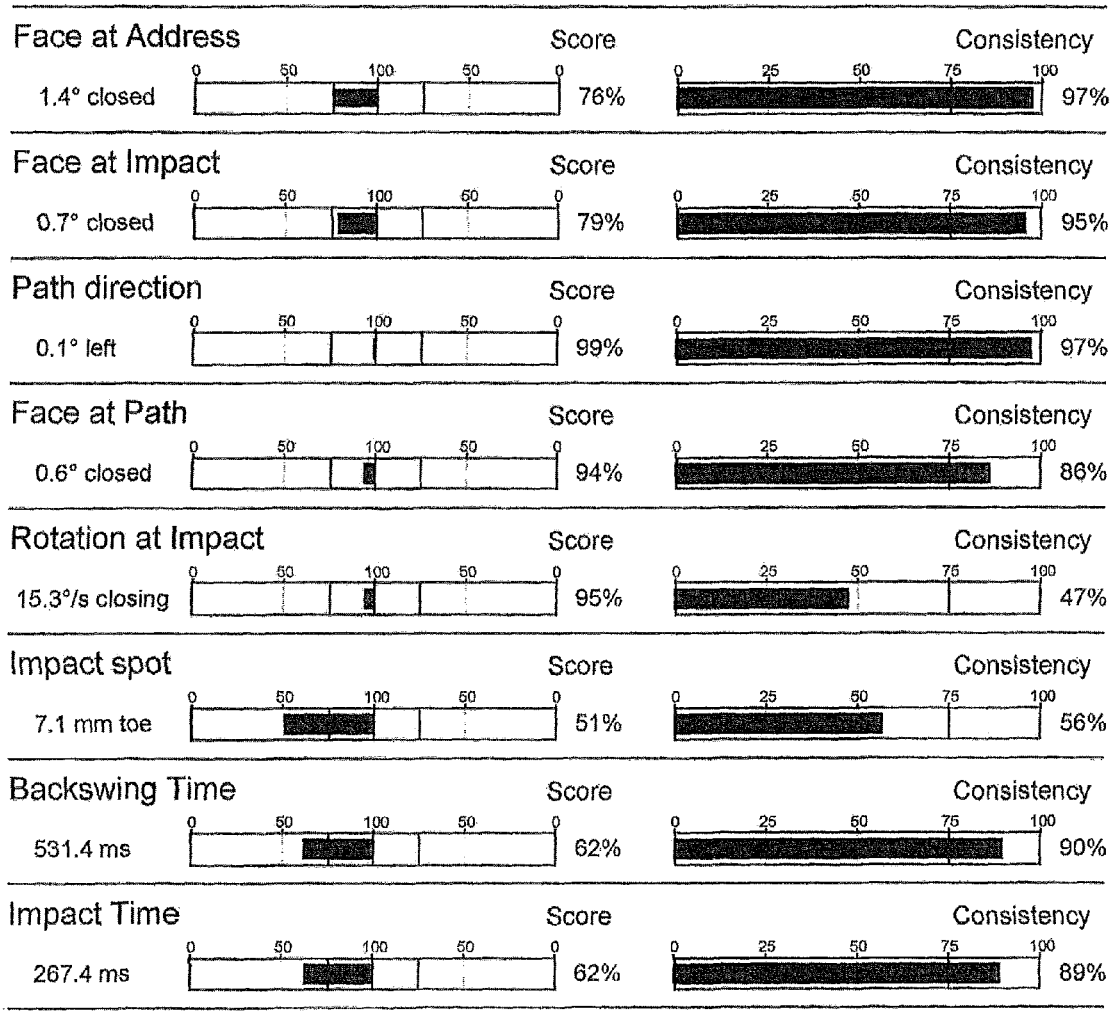

Tests were carried out using the SAM PuttLab as a measurement tool (see: http://www.samputtlab.com/) as described above. The tests were carried out in identical surroundings and the distance of each putt was 3 meters. There was no verbal instruction given to the novice golfer during the testing. For each test with a grip of the invention there was an equivalent test with a conventional grip. The objective measurements of the putting stroke measured were, as shown in the FIGS. 13-18, (a) putter face position, (b) path direction, (c) rate of club-head rotation, and (d) impact spot. There were 5 putts for each test and the distance of each putt was 3 meters. FIGS. 13, 15 and 17 are the measurements with a conventional golf grip. The putter used in all tests below was a customised Monza putter. FIGS. 14, 16 and 18 are the corresponding tests using a golf grip of the invention.

TABLE 2

Results from tests carried out using the SAM PuttLab analysis system for the novice golfer of FIGS. 13 and 14. Each putt was scored and a consistency rating was given for each measurement in each test.

| Grip Type | Putter with Standard golf grip | Putter with Golf Grip of the Invention |
|---|---|---|
| Club Length (cm) | 85.0 | 85.0 |
| Lie Angle | 71° | 71° |
| Effective Lie Angle | 71° | 75° |
| Face Position | | |
| At Address | Closed 0.0° | Closed 0.0° |
| At Impact | Closed 0.9° | Open 0.6° |
| Putter Path | 1.9° right | 1.3° right |
| Rotation at Impact | 36.9°/s closing | 41.7°/s closing |
| *Overall Average Score | 58.5% | 61.6% |

*The overall Average Score is an average of the score and consistency rating given for each measurement and assess the golfer's overall performance.

TABLE 3

Results from tests carried out using the SAM PuttLab analysis system for the 18-handicap golfer of FIGS. 15 and 16. Each putt was scored and a consistency rating was given for each measurement in each test.

| Grip Type | Putter with Standard Golf grip | Putter with Golf Grip of the Invention |
|---|---|---|
| Club Length (cm) | 85.0 | 85.0 |
| Lie Angle | 71° | 71° |
| Effective Lie Angle | 71° | 75° |
| Face Position | | |
| At Address | Open 0.2° | Open 0.2° |
| At Impact | Open 1.9° | Open 0.5° |
| Putter Path | 0.2° left | 2.5° left |
| Rotation at Impact | 21.3°/s closing | 27.3°/s closing |
| *Overall Average Score | 57.4% | 70.9% |

*The overall Average Score is an average of the score and consistency rating given for each measurement and assess the golfer's overall performance.

TABLE 4

Results from tests carried out using the SAM PuttLab analysis system for an elite golfer of FIGS. 17 and 18. Each putt was scored and a consistency rating was given for each measurement in each test.

| Grip Type | Putter with Standard Golf grip | Putter with Golf Grip of the Invention |
|---|---|---|
| Club Length (cm) | 85.0 | 85.0 |
| Lie Angle | 71° | 71° |
| Effective Lie Angle | 71° | 75° |
| Face Position | | |
| At Address | Closed 0.1° | Closed 1.4° |
| At Impact | Open 0.7° | Closed 0.7° |
| Putter Path | 2.9° right | 0.1° left |
| Rotation at Impact | 11.8°/s closing | 15.3°/s closing |
| *Overall Average Score | 74.6% | 83.0% |

*The overall Average Score is an average of the score and consistency rating given for each measurement and assess the golfer's overall performance.

For the test illustrated in FIG. 13, using a standard golf grip, the novice golfer scored an average of 58.5%. When the novice golfer carried out the same tests using the grip of the invention, with the same putter used in the first test, as illustrated in FIG. 14, the average score increased to 61.6%, with a 11% improvement in face a impact position, a 10% improvement in the impact spot test, and an 7% improvement in putter path direction. Other significant improvements for the novice golfer were his ability to line up the putter to target more consistently (increasing from 57% consistency to 94% consistency) and return to impact more accurately (increasing from 71% to 82%). The direction of the swing path scored higher in effectiveness (77% vs. 84%) and consistency (22% vs. 60%), and the face at path scores also significantly improved (20% vs. 60%). The results of this test clearly show a significant improvement in the golfer's ability to perfect the club-head path and create an ideal club-head rotation, which are both crucial elements and recognised habits of effective and successful putters. This improvement was achieved without instruction/direction of any kind.

For the test illustrated in FIG. 15, the 18-handicap golfer scored an average of 57.4%. When the 18-handicap golfer carried out the same tests using the grip as of the invention with the same putter, as illustrated in FIG. 16, the average score increased to 70.9%, a 23.5% increase in performance. The consistency of his face positions at address and impact improved significantly (65% vs. 72% and 19% vs. 86%, respectively), while his consistency with his path direction and its relationship to face also improved significantly (7% vs. 91% and 0% vs. 79%, respectively).

For the test illustrated in FIG. 17, which is with the Putter X with a conventional grip the elite golfer scored an average of 74.6%, which is understandably much higher than the novice golfer and 18-handicap golfer. However, when the elite golfer carried out the same test using the same putter but with the grip of the invention, the average score increased to 83.0%, an 11% increase in performance. The increase in performance when using the grip of the present invention was unexpected considering that the elite golfer plays on average 4 times a week. The consistency of the elite golfer improved significantly in most areas of his putting game, particularly in putter face positions at address (89% vs. 97%) and impact (80% vs. 95%), while his consistency with his path direction and its relationship to face also improved significantly (73% vs. 97% and 47% vs. 86%, respectively). In addition, the elite golfer's consistency in impact spot also increased significantly from 5% to 56%, a more than 10-fold increase.

The SAM Putt Lab and machines of its type measure objectively the putter heads positioning and tendencies at impact. What the tests describe herein prove conclusively, and what is significant is, that a player at the cognitive stage of learning had his/her scoring/consistency numbers improved by just using the putter grip of the present invention and with no verbal instruction or commands from a golf coach. The five areas measured, face position, angle of attack, path, centeredness of contact and speed are accepted worldwide as the only absolutes in which a golf stroke can be measured objectively. In the tests described herein, an improvement in the average score of all five can be translated into better performance immediately.

The words "comprises/comprising" and the words "having/including" when used herein with reference to the present invention are used to specify the presence of stated features, integers, steps or components but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A golf club comprising:

a club shaft having an upper end and a lower end and a longitudinal axis;

a club head on a lower end of the shaft, and a lie angle between the shaft and the club head;

a grip on an upper end of the shaft, wherein the structure of the grip provides an increased effective lie angle along an entire gripping area of the grip, such that a user using a two-handed gripping position on the gripping area of the golf club experiences an increased ulnar deviation in both wrists, such that the forearms of a user are substantially aligned with each other, and such that the user experiences the effective lie angle that is greater than the lie angle of the golf club, wherein the effective lie angle is in the range from greater than about 67° to about 83°, and wherein the grip is elongate in cross-sectional shape with a greater part of the grip extending on a side of the shaft on which the club head extends.

2. A golf club according to claim 1, wherein the lie angle between the shaft and the club head is in the range from about 67° to about 75°.

3. A golf club according to claim 1, wherein the effective lie angle is in the range from about 76° to about 83°.

4. A golf club according to claim 1, wherein the effective lie angle is in the range from about 77° to about 83°.

5. A golf club according to claim 1, wherein the effective lie angle is in the range from about 78° to about 83°.

6. A golf club according to claim 1, wherein the effective lie angle is in the range from about 79° to about 83°.

7. A golf club according to claim 1, wherein the effective lie angle is in the range from about 79° to about 82°.

8. A golf club according to claim 1, wherein the effective lie angle is in the range from about 80° to about 83°.

9. A golf club according to claim 1, wherein the effective lie angle is in the range from about 80° to about 82°.

10. A golf club according to claim 1, wherein the effective lie angle is in the range from about 81° to about 82°.

11. A golf club according to claim 1, wherein the grip has a longitudinal axis and the longitudinal axis of the grip and the longitudinal axis of the shaft converge in a direction toward the club head.

12. A golf club according to claim 1, wherein the elongate cross-sectional shape is substantially that of an ellipse with flat sides.

13. A golf club according to claim 1, wherein the grip tapers inwardly in a direction down the shaft and on the same side of the shaft as that on which the club head extends.

14. A golf club according to claim 1, wherein a shaft-receiving bore is defined in the grip and the bore is offset from a central position of the grip and is positioned toward the side of the grip which is opposite to the side on which the club head extends.

15. A golf club according to claim 1, wherein the part of the grip on a side of the shaft on the same side as that on which the club head extends is deformable when gripped by the user, and wherein the part of the grip on a side opposite to a side on which the club head extends is at least partially hollow.

16. A golf club according to claim 1, wherein the grip is dimensioned to fill a palm of a hand between a thumb and knuckles at a midfinger position of the hand.

17. A golf club according to claim 1, wherein the dimensions of the grip and the increased effective lie angle together act to align the forearms of the user with each other along the same plane and said plane is parallel to a longitudinal axis of the shaft in a gripping position of the club.

18. A golf club according to claim 1, wherein a longitudinal finger groove is provided on one side of the grip for seating the tips of fingers of the user in a gripping position.

19. A golf club grip according to claim 1, wherein the golf club grip member is manufactured from any one or more materials selected from the group comprising thermoplastic elastomers.

20. A method of assembling a golf club comprising a club shaft having an upper end and a lower end and a longitudinal axis; a club head on a lower end of the shaft, with a lie angle between the shaft and the club head, and a grip on an upper end of the shaft, wherein the grip includes a bore and is elongate in cross-sectional shape, wherein the grip has a first side and a second side, which is opposite to the first side, with a greater part of the grip extending on the first side of grip relative to the bore, the method comprising:

arranging the grip on the shaft with the first side of the grip on a side of the shaft on which the club head extends, such that the structure of the grip provides an increased effective lie angle along an entire gripping area of the grip, such that a user using a two-handed gripping position on the gripping area of the golf club experiences an increased ulnar deviation in both wrists, such that the forearms of a user are substantially aligned with each other, and such that the user experiences the effective lie angle that is greater than the lie angle of the golf club, wherein the effective lie angle is in the range from greater than about 67° to about 83°.

* * * * *